US012102244B2

(12) United States Patent
Shelowitz et al.

(10) Patent No.: US 12,102,244 B2
(45) Date of Patent: Oct. 1, 2024

(54) ICE MOLD FOR MAKING ICE STRAWS

(71) Applicants: Bradley Shelowitz, Long Beach, NY (US); Christopher Smith, Ronkonkoma, NY (US)

(72) Inventors: Bradley Shelowitz, Long Beach, NY (US); Christopher Smith, Ronkonkoma, NY (US)

( * ) Notice: Subject to any disclaimer, the term of this patent is extended or adjusted under 35 U.S.C. 154(b) by 0 days.

(21) Appl. No.: 18/448,227

(22) Filed: Aug. 11, 2023

(65) Prior Publication Data

US 2024/0049897 A1 Feb. 15, 2024

Related U.S. Application Data

(63) Continuation-in-part of application No. 18/160,759, filed on Jan. 27, 2023.

(60) Provisional application No. 63/371,438, filed on Aug. 15, 2022.

(51) Int. Cl.

| | |
|---|---|
| ***A23G 9/00*** | (2006.01) |
| ***A47G 21/18*** | (2006.01) |
| ***B29C 33/00*** | (2006.01) |
| ***F25C 1/00*** | (2006.01) |
| ***F25C 1/08*** | (2006.01) |
| ***F25C 1/22*** | (2018.01) |
| *F25C 1/25* | (2018.01) |

(52) U.S. Cl.

CPC ..... *A47G 21/187* (2013.01); *F25C 1/08* (2013.01); *F25C 1/22* (2013.01); *A47G 2400/105* (2013.01); *F25C 1/25* (2018.01)

(58) Field of Classification Search

CPC .. F25C 1/08; A23G 9/00; B29C 33/00; A47G 21/18

See application file for complete search history.

(56) References Cited

U.S. PATENT DOCUMENTS

| | | | | |
|---|---|---|---|---|
| 2,072,518 | A * | 3/1937 | Brown | F25C 1/24 249/82 |
| 3,321,932 | A * | 5/1967 | Orphey, Jr. | F25C 1/24 62/340 |
| 2015/0182045 | A1* | 7/2015 | Hobeich | B65D 47/06 215/229 |
| 2020/0060457 | A1 | 2/2020 | Zezula | |
| 2022/0218135 | A1* | 7/2022 | Surgent | A47G 21/18 |

FOREIGN PATENT DOCUMENTS

| | | | | |
|---|---|---|---|---|
| EP | 2208686 | B1 * | 10/2012 | A47G 19/06 |

* cited by examiner

*Primary Examiner* — Susan D Leong
*Assistant Examiner* — John W Hatch
(74) *Attorney, Agent, or Firm* — Bradley J. Shelowitz

(57) ABSTRACT

An ice mold for forming hollow, elongated ice structures intended to be used as drinking straws. The ice mold includes an outer tube, an inner tube concentrically positioned within the outer tube, and top and bottom caps that fluidly seal a chamber defined between the outer tube, the inner tube, the top cap, and the bottom cap.

19 Claims, 23 Drawing Sheets

604
604b
604
"S"
"SO"
"SI"
606c
606b
604a 600
602
608
618
602a
"S"
606c
606b
607
604a
607
606

612
618
608
600
602
606c
606b
607
604a
607
606

ICE MOLD FOR MAKING ICE STRAWS

CROSS-REFERENCE TO RELATED APPLICATIONS

This application is a Continuation-in-Part of U.S. patent application Ser. No. 18/160,759 filed on Jan. 27, 2023, which claims the benefit of and priority to U.S. Provisional Patent Application No. 63/371,438 filed on Aug. 15, 2022, the entire contents of each of which are incorporated by reference herein.

TECHNICAL FIELD

The present disclosure generally relates to ice molds and ice machines, and more particularly to ice molds and ice machines for making ice having an elongated, hollow configuration.

BACKGROUND

Drinking straws are typically made of plastic. There is a growing trend towards using materials for straws that are biodegradable or at the very least more ecofriendly than plastic. Many of the alternative materials continue to produce waste and/or lack usability.

SUMMARY

In an aspect of the present disclosure, a mold for forming a straw-shaped ice structure is provided. The mold includes an outer tube, an inner tube configured to extend centrally through the outer tube, a top cap, and a bottom cap. Each of the outer tube and the inner tube has an opened top end, and an opened bottom end. The top cap is configured for receipt in the opened top end of the outer tube and defines a channel configured for receipt of the inner tube. The bottom cap is configured for receipt in the opened bottom end of the outer tube and defines a channel configured for receipt of the inner tube. The outer and inner tubes and the top and bottom caps are configured to collectively define a closed elongated channel therebetween configured to hold a freezable substance therein.

In accordance with another aspect of the present disclosure, a mold for forming ice straws is provided and includes a hollow, outer tube having a top end and a bottom end, a top cap positioned within the top end of the outer tube and defining a central channel, a bottom cap positioned within the bottom end of the outer tube and defining a central channel, and an elongated inner member positioned concentrically within the outer tube. The elongated inner member includes a top end extending through or protruding from the central channel of the top cap, and a bottom end extending through or protruding from the central channel of the bottom cap. The top cap closes the top end of the outer tube and forms a fluid-tight seal between the top end of the outer tube and the top end of the elongated inner member. The bottom cap closes the bottom end of the outer tube and forms a fluid-tight seal between the bottom end of the outer tube and the bottom end of the elongated inner member.

In accordance with yet another aspect of the present disclosure, a method of making a straw-shaped ice structure is provided and includes filling an elongated channel with a freezable substance, the elongated channel being defined between a metal outer tube, a metal inner tube concentrically disposed within the outer tube, and a bottom cap that forms a fluid-tight seal with a bottom end of the inner tube and a bottom end of the outer tube; positioning a top cap in a top end of the outer tube thereby forming a fluid-tight seal between the top end of the outer tube, and the inner tube; and positioning the mold in a freezer in either a vertical orientation or a horizontal orientation, whereby the freezable substance freezes into a straw-shaped ice structure and urges at least one of the top cap away from the top end of the outer tube or the bottom cap away from the bottom end of the outer tube.

In aspects, the method may further include flowing water onto a tapered or ramped bottom end portion of the bottom cap, whereby the water flows through the inner tube via a bottom end of the inner tube and over and along an outer surface of the outer tube to thaw an outer surface and an inner surface of the straw-shaped ice structure; and sliding the top cap and the inner tube relative to and out of the outer tube to release the straw-shaped ice structure from the outer tube while the straw-shaped ice structure is supported vertically on a bottom surface of the top cap.

BRIEF DESCRIPTION OF THE DRAWINGS

The present disclosure will become more readily apparent from the specific description accompanied by the following drawings, in which.

DETAILED DESCRIPTION

The present disclosure may be understood more readily by reference to the following detailed description of the disclosure taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure. Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior."

As used herein the term "distal" refers to that portion of the ice mold that is further from a base or stand thereof, while the term "proximal" refers to that portion of the ice mold that is closer to the base or stand. As used herein, the term "coupled" means that two portions are directly or indirectly connected to one another or monolithically formed with one another.

Figure 1:
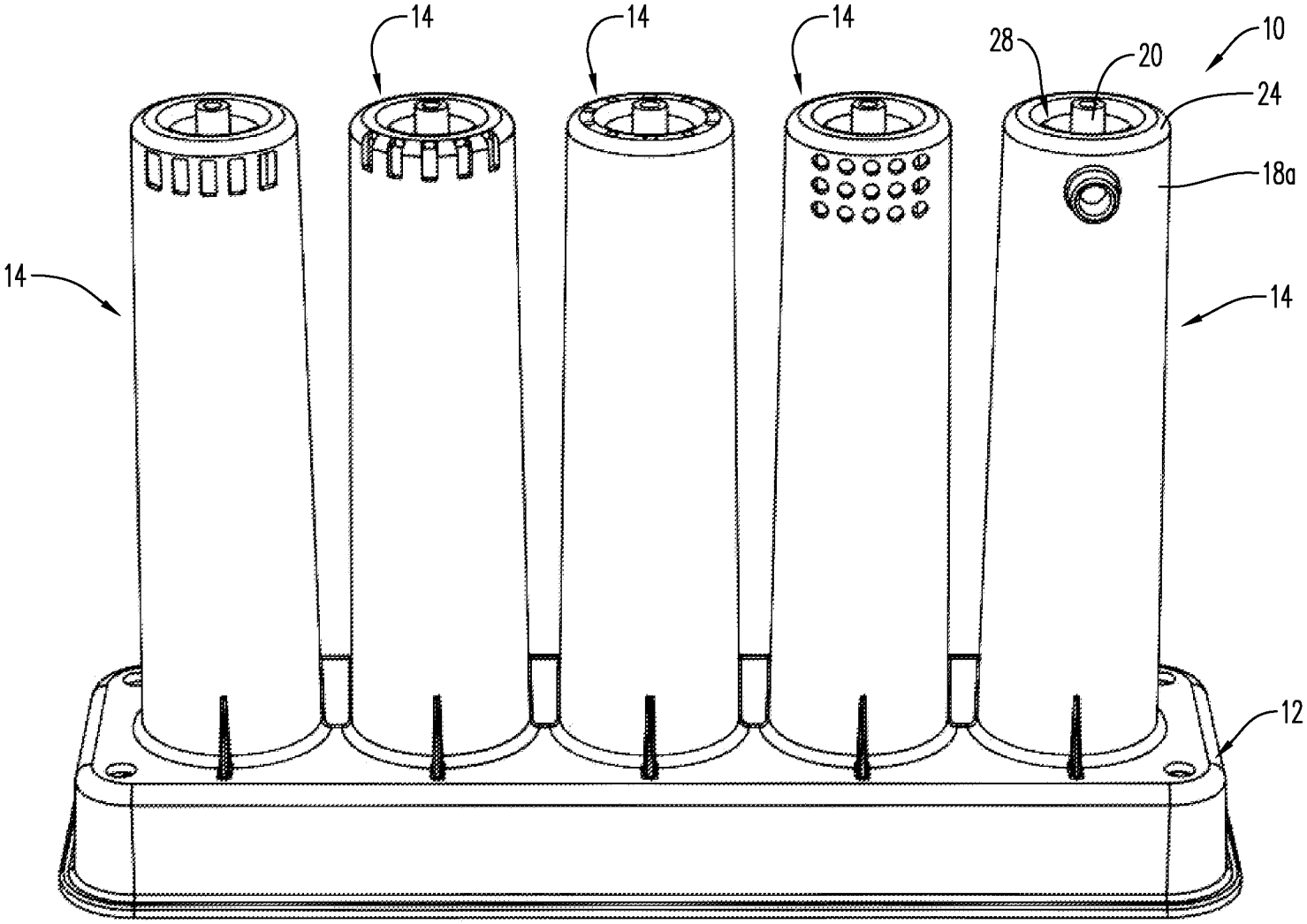
FIG. 1 is a front, perspective view of an exemplary embodiment of an ice mold for making ice straws.
Figure 5:
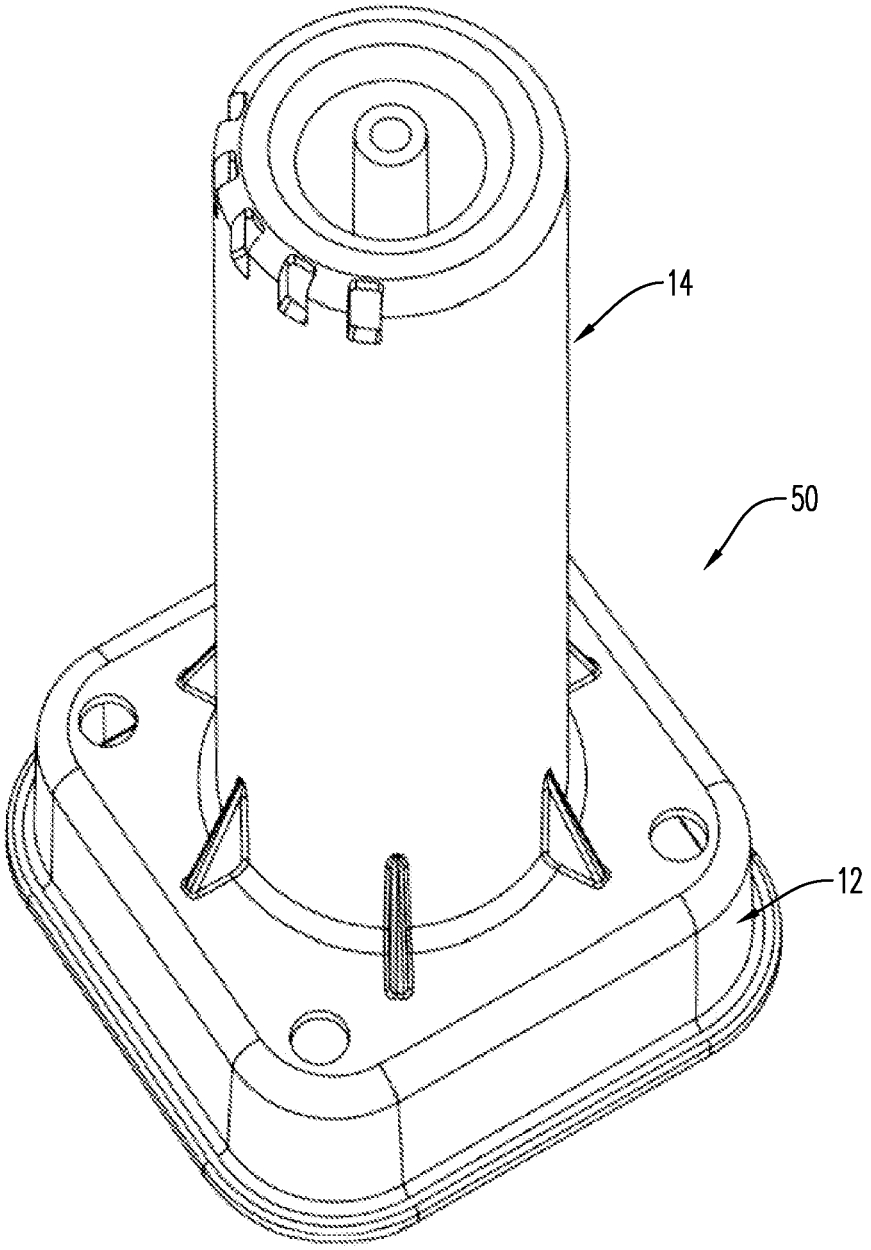
FIG. 5 is a top, perspective view illustrating another aspect of an ice mold.

With reference to FIGS. 1-4, an embodiment of an ice tray or mold 10 for making drinking straws made from ice (i.e., ice straws) is illustrated. The ice mold 10 generally includes a base or stand 12 and a plurality of column assemblies 14 extending vertically from the stand 12. The stand 12 may have a rectangular shape and defines a hollow cavity 16 therein configured for receipt of a warm fluid during removal of the ice straws, as will be described. Other suitable shapes for the base 12 are also contemplated. The ice mold 10 may include any suitable number of column assemblies 14, such as, for example, five as shown in FIG. 1 or more, and in some aspects an ice mold 50 is provided having only a single column assembly 14 (FIG. 5). It is contemplated that the ice mold 10 is monolithically formed and fabricated from a flexible or semi-flexible material, such as, for example, silicon, rubber, polypropylene, nylon, or the like. In other aspects, the housing 12 may be fabricated from a hard material, such as, for example, metal, a hard plastic (e.g., PVC), or any other suitable material.

Each of the column assemblies 14 includes a double-walled outer column 18 and a single-wall inner shaft or tube 20 positioned centrally within the double-walled outer column 18. The double-walled outer column 18 includes a cylindrical outer wall 18*a* and a cylindrical inner wall 18*b* positioned within the outer wall 18*a* and spaced radially inward therefrom to define a longitudinally-extending, annular inner channel 22. The double-walled outer column 18 is closed at its distal end with a disc-shaped portion 24 that interconnects the distal ends of the outer and inner walls 18*a*, 18*b* of the double-walled outer column 18. The double-walled outer column 18 is opened at its proximal end such that the inner channel 22 is in fluid communication with the cavity 16 of the stand 12 such that warming fluid received in the cavity 16 may be directed into each of the inner channels 22.

Figure 2:
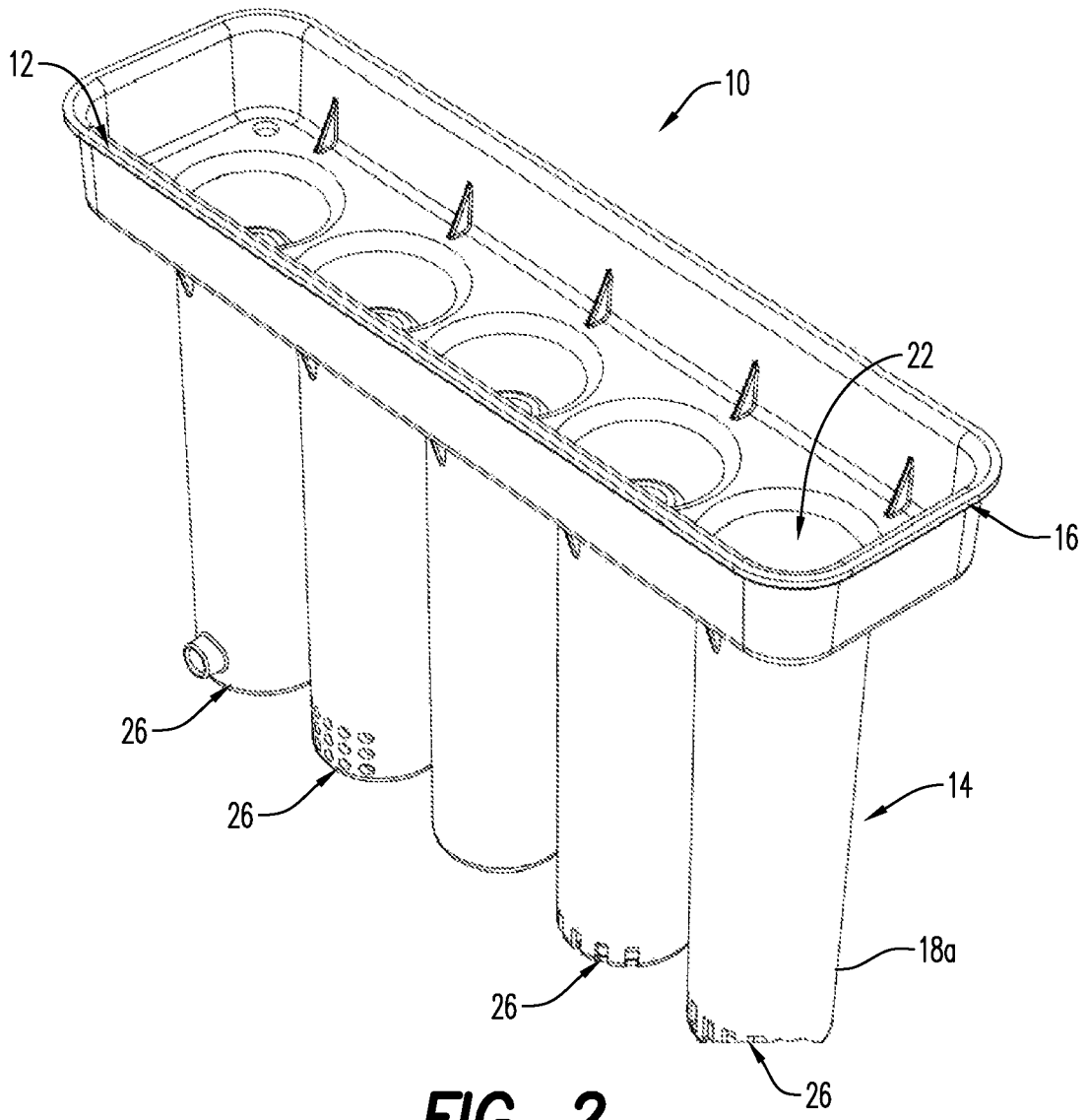
FIG. 2 is a bottom, perspective view illustrating the ice mold of FIG. 1.
Figure 3:
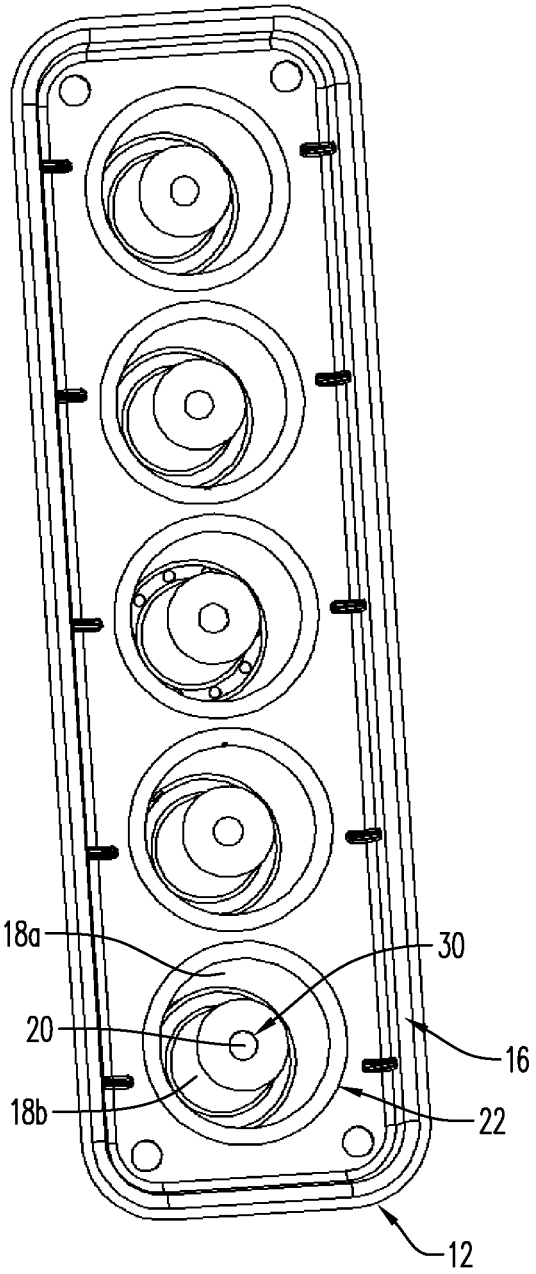
FIG. 3 is a bottom view of the ice mold of FIG. 1.
Figure 4:
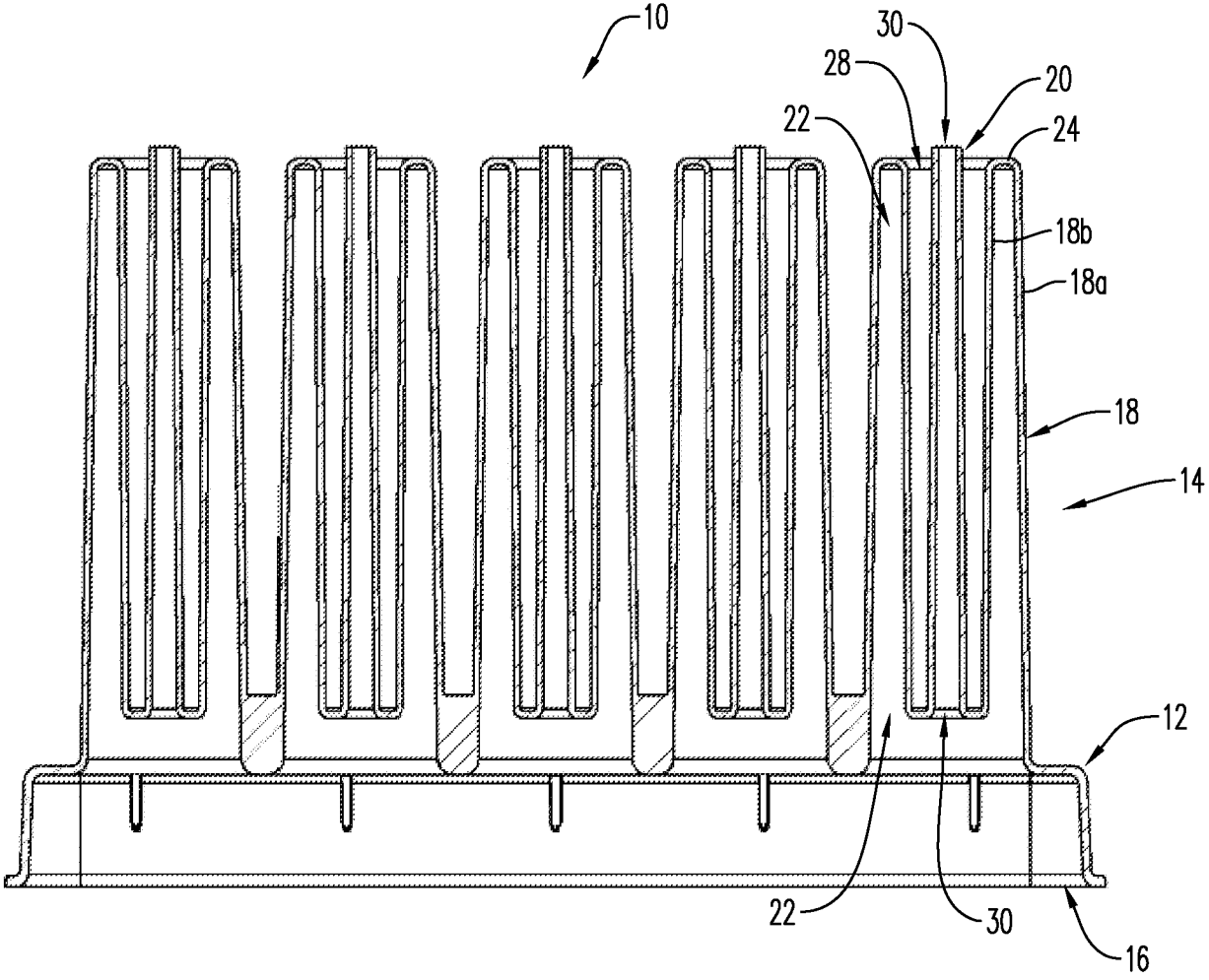
FIG. 4 is a cross-sectional view of the ice mold of FIG. 1.

As shown in FIGS. 1 and 2, the outer wall 18*a* of the double-walled outer column 18 has a fluid opening 26 at the distal end thereof configured to direct the warm fluid out of the inner channel 22 to allow for an uninterrupted fluid flow. The fluid opening 26 may be defined in the outer wall 18*a* and may be a port, a plurality of round openings, or a plurality of square or rectangular openings. In other aspects, the fluid opening 26 may be formed in the disc-shaped portion 24 of the double-walled outer column 18.

The tube 20 of each of the column assemblies 14 is spaced radially inward from the inner wall 18*b* of the double-walled outer column 18 to define a longitudinally-extending, annular outer channel 28 between the tube 20 and the inner wall 18*b* of the double-walled outer column 18. The outer channel 28 has an opened distal end configured for receiving liquid (e.g., water) and a closed proximal end such that the outer channel 28 may hold water therein. In aspects, the outer channel 28 may assume any suitable shape, such as, for example, cylindrical, rectangular, star-shaped, triangular, hexagonal, or the like, which will give an outer surface of ice formed therein a corresponding shape.

The tube 20 defines a hollow passageway 30 therethrough and has a proximal end connected with a proximal end of the inner wall 18*b* of the double-walled outer column 18 and an opened distal end that protrudes distally beyond a distal end of the double-walled outer column 18. The proximal end of the tube 20 is opened to the cavity 16 of the stand 12 such that warm fluid that enters the cavity 16 may be directed into the tube 20 via the opened proximal end thereof, travel distally through the hollow passageway 30, and exit the tube 20 via the distal end thereof. To facilitate removal of the ice straw from the inner channels 28, the inner channels 28 and the tubes 20 may taper in the distal direction. This will also result in the ice straws having one end with a thinner wall than the other end.

In aspects, the distal ends of the column assemblies 14 may be provided with caps or condoms (not explicitly shown) that have a central boss and an outer ring configured for respective receipt in the opened distal end of the tube 20 and the opened distal end of the inner channel 28. In aspects, the inner surface of the inner wall 18*b* and the outer surface of the tube 20 may be coated with a lubricious material, such as, for example, PTFE. It is contemplated that liquids other than water may be filled into the inner channels 28, such as, for example, gelatin-based liquids, sugar-containing liquids, or the like.

In use, the ice mold 10 may be positioned in an upright manner with the stand 12 supported on a flat surface and the column assemblies 14 extending vertically upward, as shown in FIG. 1. Water, or other suitable liquid, may be poured into the distal end of the inner channel 28 of each of the column assemblies 14 until the inner channels 28 are filled with the liquid. With the inner channels 28 filled with the liquid, the ice mold 10 may be placed in a freezer until the water converts into ice. Since the inner channels 28 are elongated with a ring-shaped cross-section, the ice formed within the inner channels 28 assume a straw-like shape with a central passageway therethrough. It is contemplated that the ice (i.e., ice straws) may have a length of from about 5 inches to about 9 inches, a wall thickness of about 0.12 inches, and a central channel with a diameter of about 0.24 inches.

To dislodge or remove the ice straws from the inner channels 28, the ice mold 10 may be turned upside down so that the cavity 16 defined in the stand 12 is facing upright and the column assemblies 14 are pointing downward, as shown in FIG. 2. Warm fluid (e.g., water) may be poured into the cavity 16 in the stand 12, whereby the warm water passes into the outer channel 22 of each the column assemblies 14 and the hollow passageway 30 of each of the tubes 20. In aspects, instead of pouring the warm fluid into the cavity 16 of the stand 12, the warm fluid may be poured directly into a single outer channel 22 and passageway 30 of a selected column assembly 14. The warm fluid passes distally through the outer channel 22 and the hollow passageway 30 whereby heat is transferred from the warm fluid through the outer wall 18*a* and into the outer surface of the ice straw, and from the warm fluid through the tube 20 and into the inner surface of the ice straw. As heat is transferred from the warm fluid and into the outer and inner surfaces of the ice straw, the inner and outer surfaces of the ice straw sufficiently melt to allow for gravity to dislodge the ice straws from the ice mold 10.

Figure 6:
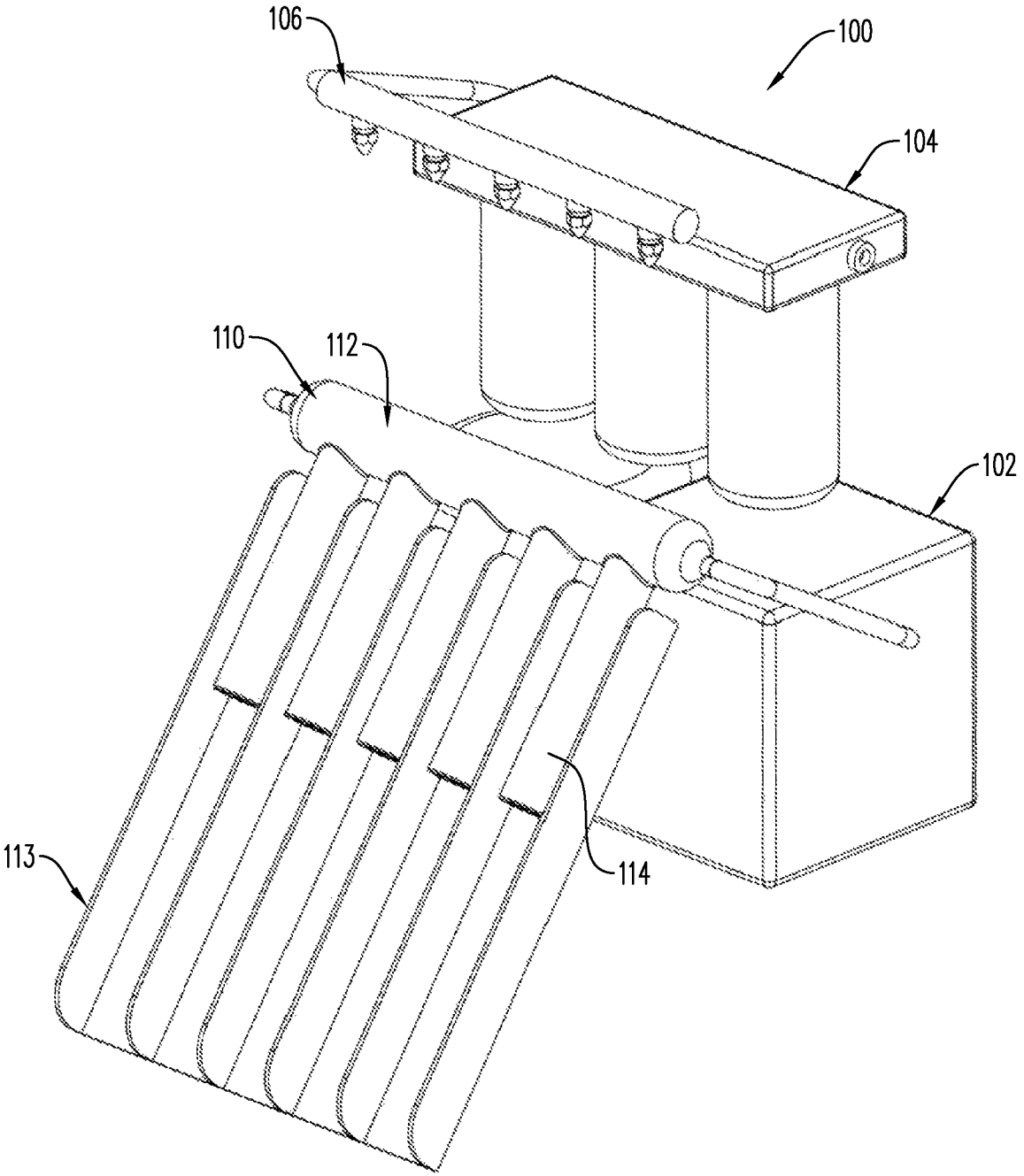
FIG. 6 is a perspective view illustrating an ice machine for making ice straws.
Figure 7:
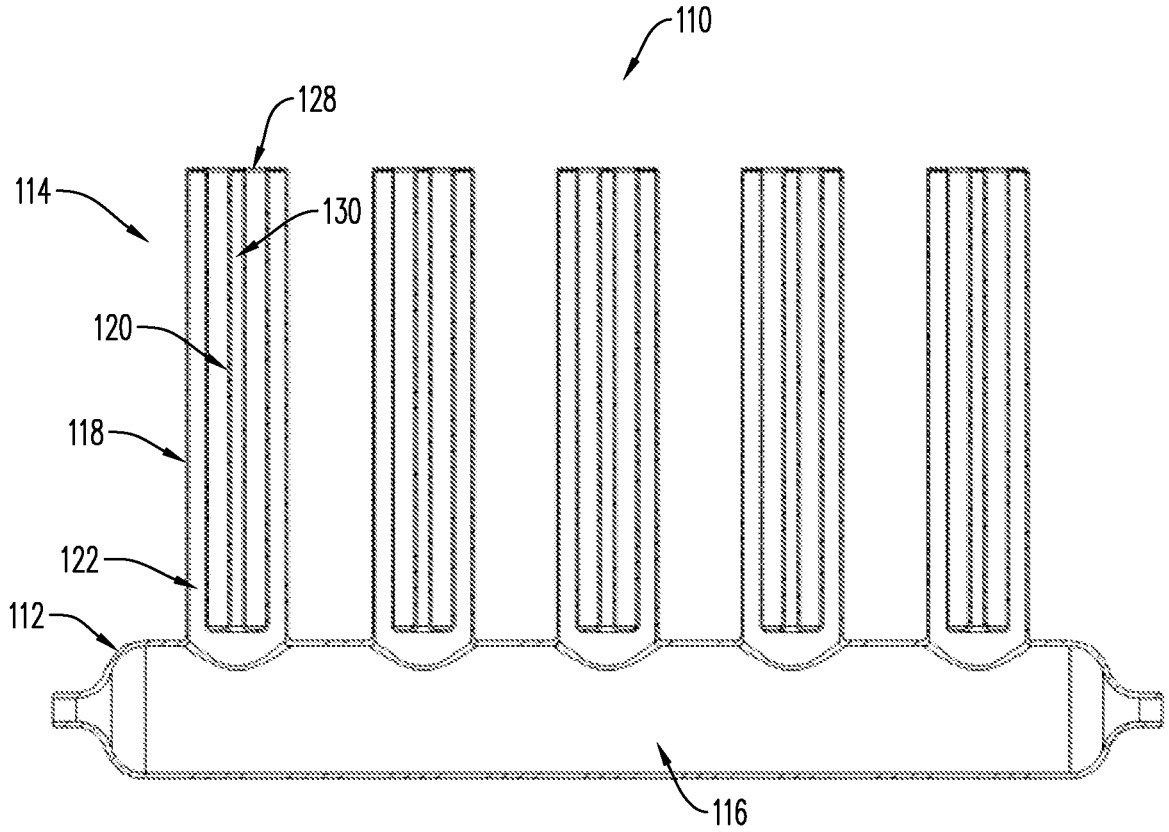
FIG. 7 is a cross-sectional view illustrating an evaporator of the ice machine of FIG. 6.

With reference to FIGS. 6 and 7, the present disclosure also provides a machine 100 configured to produce ice straws. The ice straw machine 100 generally includes a compressor 102 for storing and compressing refrigerant, a water filter 104 for receiving water from a water source, a nozzle assembly 106 for dispensing filtered water, an evaporator or ice mold 110, and a drop tray 113. The ice machine 100 may further include other, standard components of an ice machine, such as a condenser, an expansion valve, and the like.

The ice mold 110 may be substantially similar to the ice mold 10 described with reference to FIGS. 1-4. As such, only selected distinctions will be elucidated herein. The ice mold 110 includes a base 112 and a plurality of column assemblies 114 extending perpendicularly from the base 112 and arranged in a linear array on the base 112. The base 112 defines a cavity 116 therein that is in fluid communication with the compressor 102. The base 112 may be hingedly supported on the compressor 102, a housing (not explicitly shown), or another suitable component of the ice machine 100, to allow for the column assemblies 114 of the ice mold 110 to rotate between a fluid-receiving position (not explicitly shown), and an ice-dispensing position, as shown in FIG. 6. In the fluid-receiving position, the distal ends of the column assemblies 114 are positioned directly underneath respective nozzles of the nozzle assembly 106 to receive filtered water therefrom. In the ice-dispensing position, the distal ends of the column assemblies 114 are positioned downwardly and received in respective chutes of the drop tray 113.

The column assemblies 114 each include a double-walled outer column 118 and a tube 120 positioned centrally within the double-walled outer column 118. The double-walled outer column 118 defines an outer channel 122, and the tube 120 defines a central passageway 130 each of which being in fluid communication with the cavity 116 of the base 122. The compressor 102 is configured to dispense refrigerant into the cavity 116 in the base 112 of the ice mold 110 and into the outer channel 122 and the central passageway 130 of the tube 120 to freeze water held in an inner channel 128 defined between the double-walled outer column 118 and the tube 120. The compressor 102 is also configured to dispense a warm fluid, such as, for example, a warm gas or liquid, into the cavity 116 of the base 112 and into the outer channel 122 and the central passageway 130 of the tube 120 to warm the ice formed in the inner channel 128 to assist in dislodging the ice from the ice mold 110. In other aspects, water from the nozzle assembly 106 may be fed directly into the outer channel 122 and the central passageway 130 to facilitate melting and dislodging of the ice straws from the ice mold 110.

Figure 8:
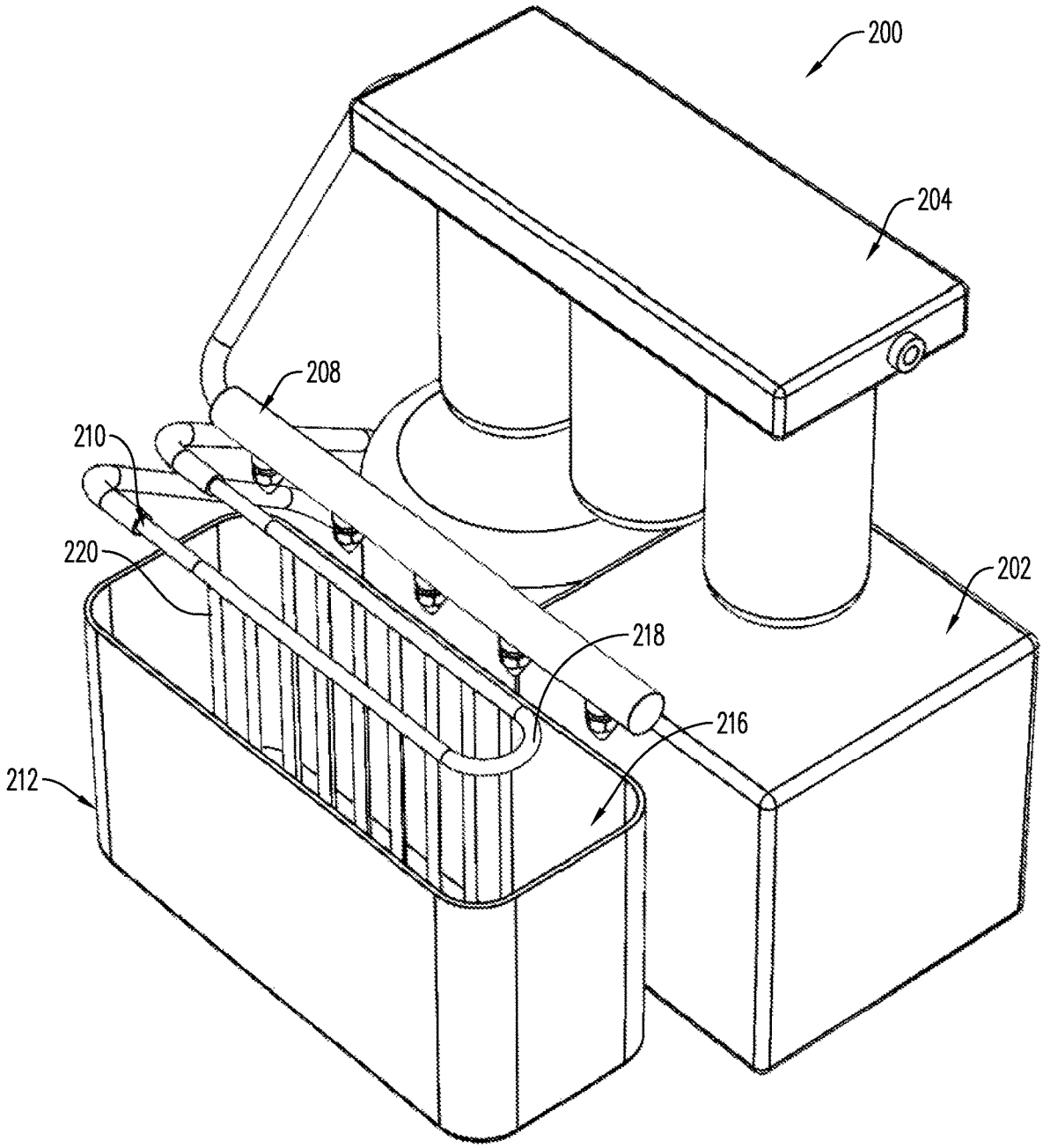
FIG. 8 is a perspective view illustrating another aspect of an ice machine for making ice straws.
Figure 9:
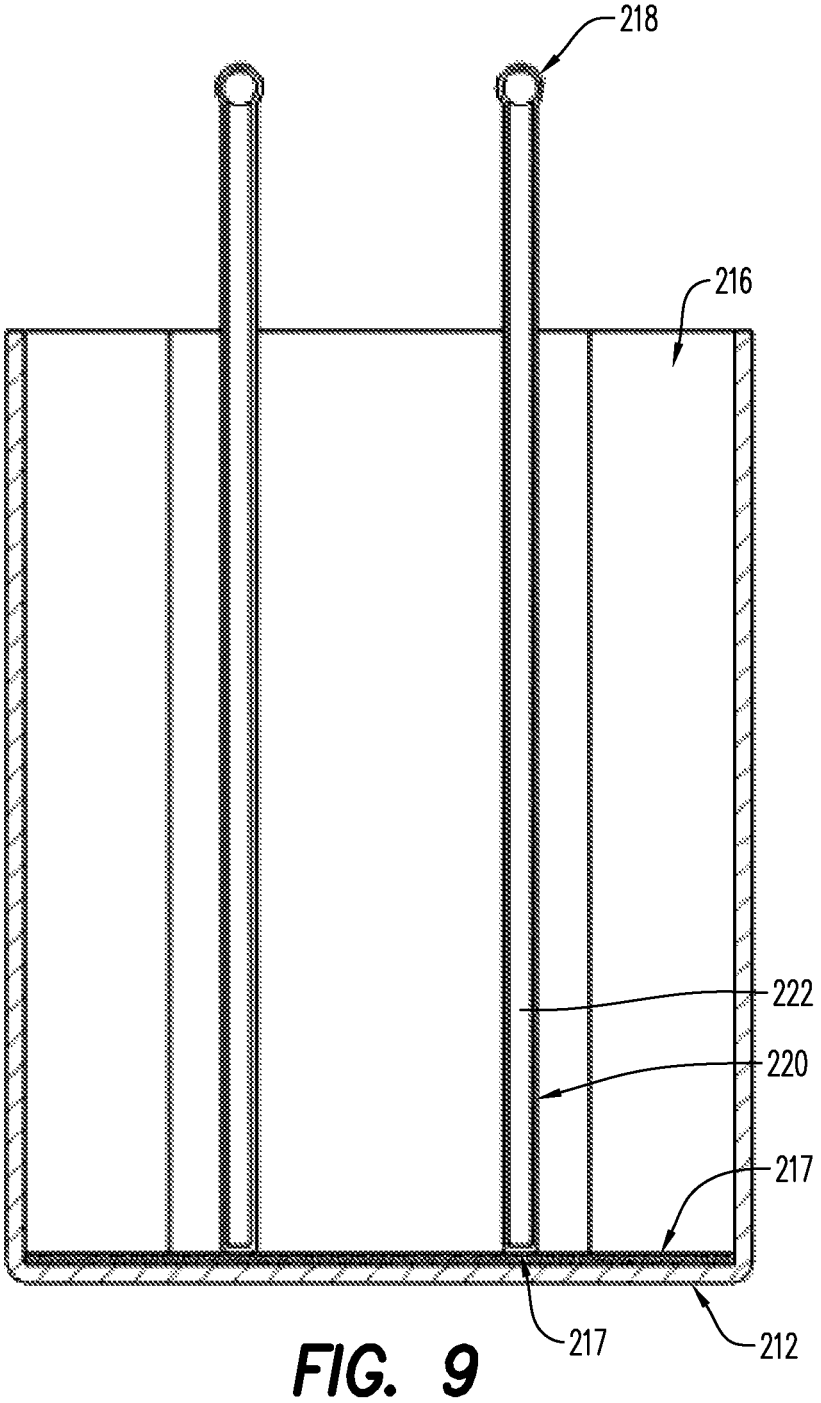
FIG. 9 is a cross-sectional view illustrating an evaporator and a drop tray of the ice machine of FIG. 8.

With reference to FIGS. 8 and 9, another aspect of an ice machine 200 for producing ice straws is provided and is similar to the ice machine 100 of FIGS. 6 and 7. As such, only selected distinctions will be elucidated herein. The ice machine 200 generally includes a compressor 202 for storing and pressurizing refrigerant, a water filter 204 for receiving water from a water source, a nozzle assembly 206 in fluid communication with the water source and configured to dispense filtered water, an evaporator 210, and a container or drop tray 212. The evaporator 210 includes an elongated tubular member 218 that receives the cold refrigerant from the compressor 202, and a plurality of hollow stems or prongs 220 extending perpendicularly from the elongated tubular member 218. The elongated tubular member 218 may be U-shaped as shown, linear, undulating, or any other suitable shape.

Each of the prongs 220 define a freeze/thaw chamber 222 therein in fluid communication with the elongated tubular member 218 and configured to receive the cooled refrigerant. The prongs 220 of the evaporator 210 extend into a cavity 216 defined in the drop tray 212 and each have closed distal ends that contact a pad 217 positioned at a bottom of the drop tray 212. The pad 217 may be fabricated from a resilient material, such as, for example, silicone to prevent ice from forming over the distal tip of the prongs 220. Upon ice straws being formed around each of the prongs 220, the evaporator 210 may be lifted out of the drop tray 212 or the drop tray 212 may be lowered to release the pad 217 from the prongs 220 thereby facilitating release of the ice straws into the drop tray 212.

It is contemplated that the prongs 220 may be replaced with cylindrical shells (not shown) that allow for the formation of straw-shaped ice therein. As the cylindrical shells receive cooled refrigerant, the cylindrical shells form the ice in an outside-in direction. This is in contrast with the prongs 220, which form the ice in an inside-out direction. When the ice has formed to a suitable thickness, the water within the chamber 216, which is also within a central channel of the ice (i.e., the unfrozen portion of the liquid), is drained.

Figure 10:
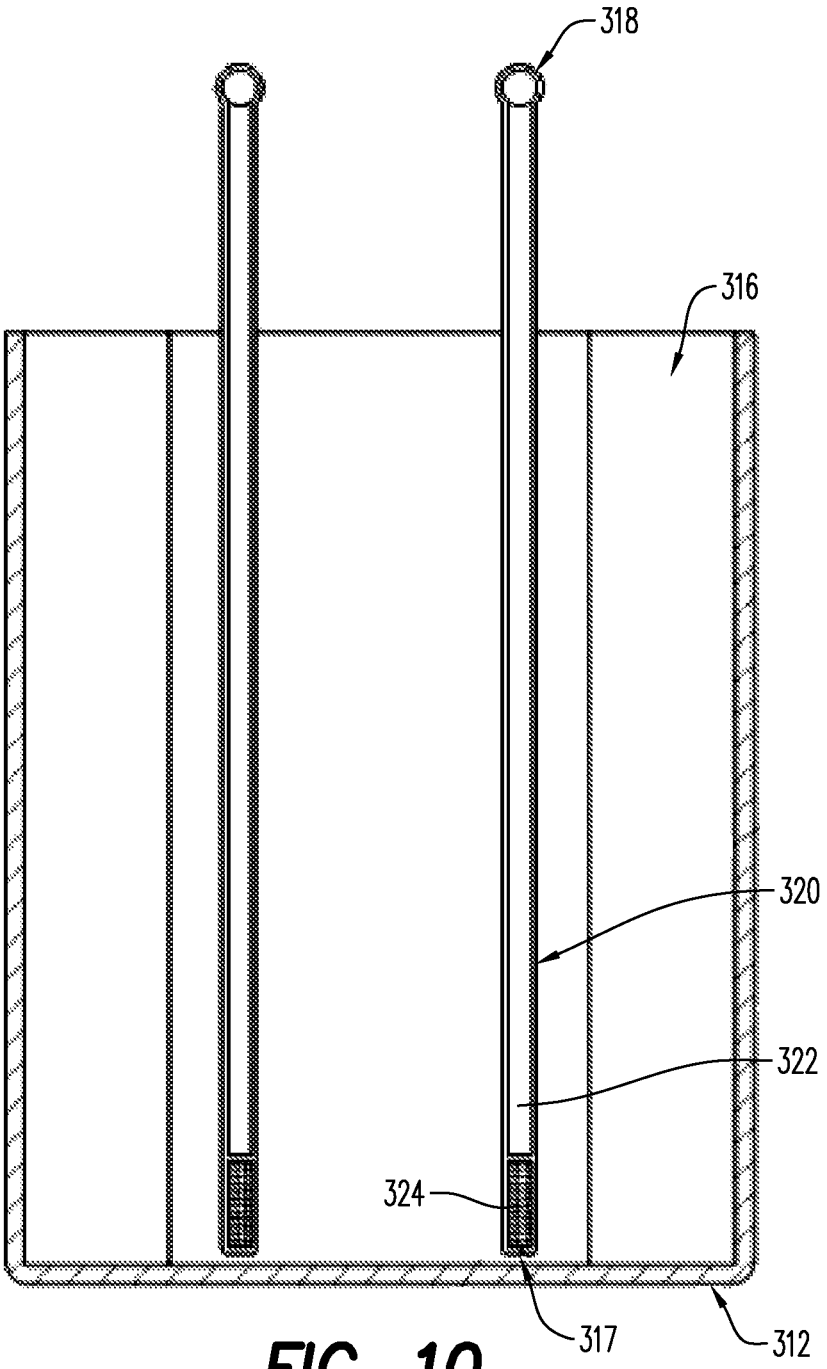
FIG. 10 is a cross-sectional view illustrating another embodiment of an evaporator and drop tray of the ice machine of FIG. 8.
Figure 11:
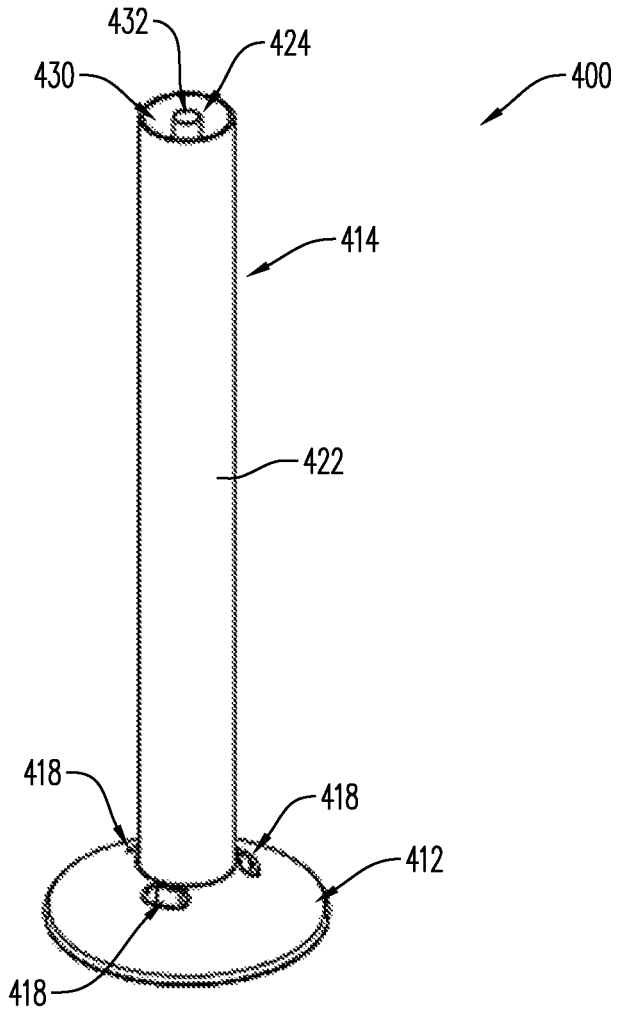
FIG. 11 is a perspective view illustrating another embodiment of an ice mold for making ice straws.
Figure 12:
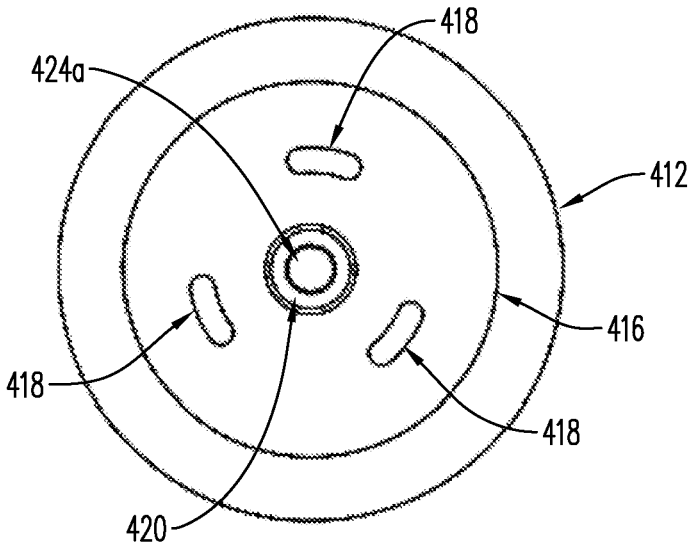
FIG. 12 is a bottom view illustrating the ice mold of FIG. 11.
Figure 13:
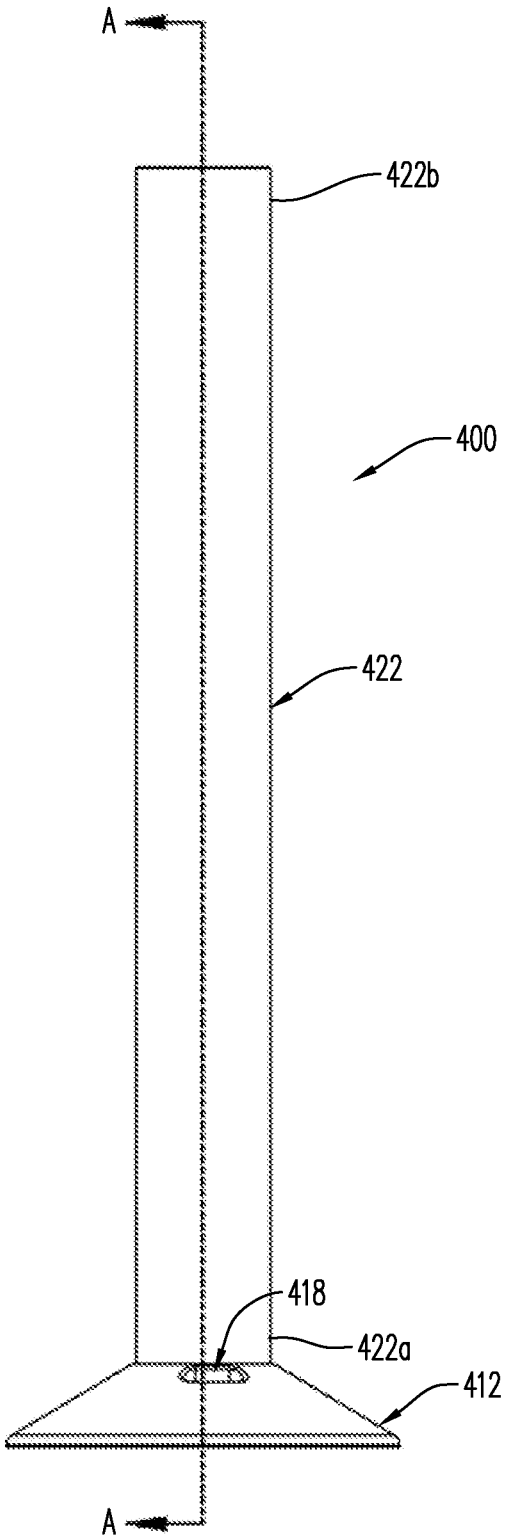
FIG. 13 is a side view illustrating the ice mold of FIG. 11.
Figure 14:
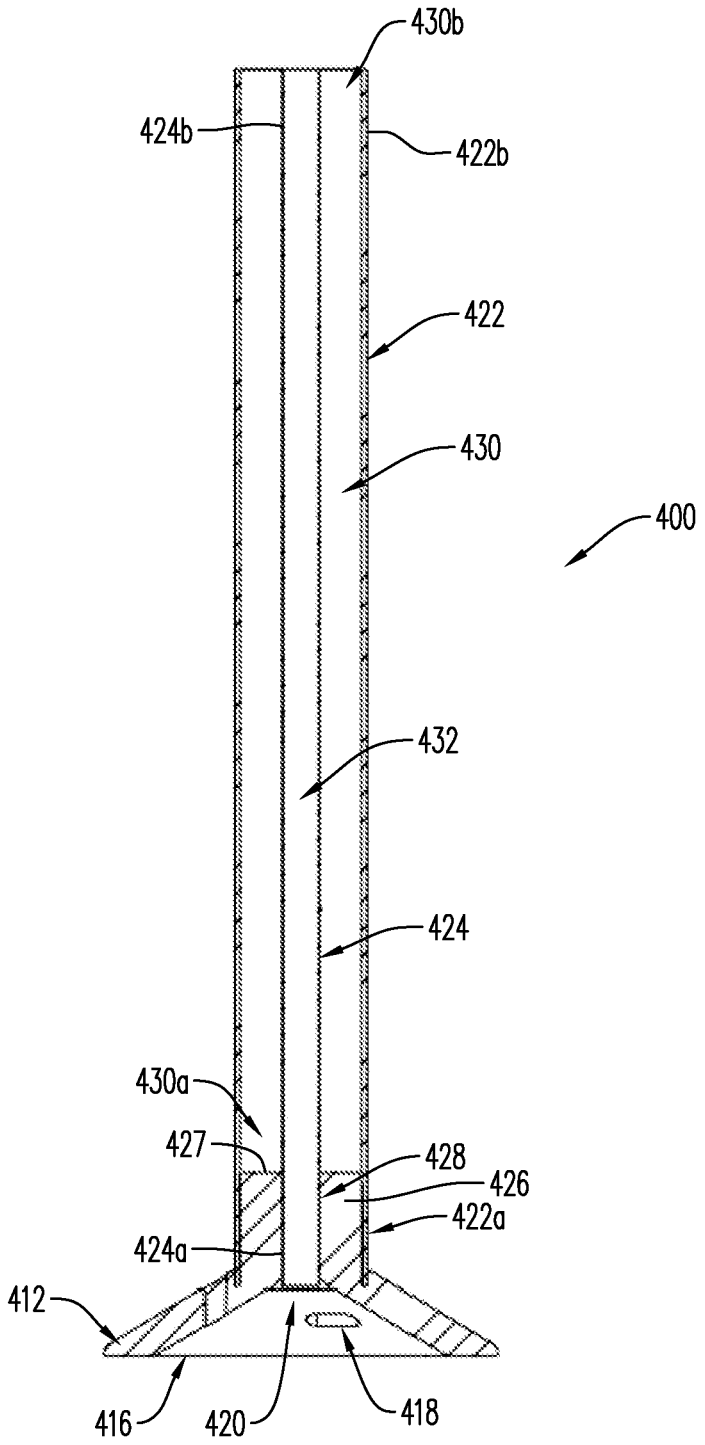
FIG. 14 is a longitudinal cross-section, taken along line A-A in FIG. 13, illustrating the ice mold of FIG. 11.

With reference to FIG. 10, another aspect of an evaporator 300 for use with the ice machine 100 of FIGS. 8 and 9 is provided. The evaporator 300 includes an elongated tubular member 318 that receives the cold refrigerant from the compressor 202, and a plurality of hollow stems or prongs 320 extending perpendicularly from the elongated tubular member 318. The elongated tubular member 318 may be U-shaped as shown, linear, undulating, or any other suitable shape.

Each of the prongs 320 define a freeze/thaw chamber 322 therein in fluid communication with the elongated tubular member 318 and configured to receive the cooled refrigerant. The prongs 320 extend into a cavity 316 defined in a drop tray 312 and each have closed distal ends 317 positioned at a bottom of the drop tray 312. The distal ends 317 of the prongs 320 have an insulation material (e.g., air, a vacuum, silicone, polymers, or the like) filled therein to prevent ice from forming around the distal ends 317 of the prongs 320 such that the prongs 320 form ice straws having opened distal ends. In another aspect, the distal ends 317 of the prongs 320 may have an insulation tip attached thereto.

With reference to FIGS. 11-14, another embodiment of an ice tray or mold 400 for making drinking straws made from ice (i.e., ice straws or straw-shaped ice structures) is illustrated. The ice mold 400 generally includes a base or stand 412 and a column assembly 414 extending vertically from the stand 412. In aspects, similar to the ice mold 10 of FIGS. 1-4, the mold 400 of the present embodiment may include a stand configured to fixedly or detachably support a plurality of column assemblies 414. The stand 412 may have a frusto-conical or funnel shape and defines a conical-shaped cavity 416 (FIG. 14) therein configured for receipt of a thawing fluid during removal of the ice straws, as will be described. Other suitable shapes for the base 412 are also contemplated.

The base 412 protrudes radially outward from the column assembly 414 and defines a plurality of apertures 418 (e.g., three apertures) that are circumferentially spaced from one another. The base 412 further defines a central opening 420 therethrough that is in fluid communication with the cavity 416 to facilitate passage of the thawing fluid into and onto the components of the column assembly 414.

The column assembly 414 generally includes a hollow, outer tube 422, a stopper 426 (FIG. 14) secured within a bottom or proximal end portion 422*a* of the outer tube 422, and an inner tube 424 positioned concentrically (e.g., centrally) within the outer tube 422. The outer tube 422 may have a circular cross-sectional shape. Other cross-sectional shapes of the outer tube 422 are contemplated, such as, for example, triangular, square, star-shaped, etc. The outer tube 422 may be fabricated from a rigid material, such as, for example, aluminum or stainless steel, may have a length from about 4 inches to about 13 inches, and may have a diameter from about 0.5 inches to about 1.5 inches, and in some aspects, a diameter from about 0.7 inches to about 0.9 inches.

The stopper 426 defines a central channel 428 therethrough and assumes a cylindrical shape or any suitable shape corresponding to the shape of the proximal end portion 422*a* of the outer tube 422. The stopper 426 may be fabricated from an elastic material, such as, for example, food-grade rubber or plastic, and is secured within the proximal end portion 422*a* of the outer tube 422. In aspects, the outer tube 422 may have an annular projection (not explicitly shown) extending from an inner surface of the proximal end portion 422*a* to frictionally engage the entire outer surface of the stopper 426 to prevent the stopper 426 from sliding out of the proximal end portion 422*a* of the outer tube 422. In other aspects, the stopper 426 may be secured within the outer tube 426 using a press-fit, fasteners, adhesives, or the like. It is contemplated that the stopper 426 may be alternately configured to be removable from the outer tube 422. In aspects, the stopper 426 and the base 412 may be monolithically formed with one another. In other aspects, the stopper 426 and the base 412 may be separate components. In aspects, a cap or stopper may be provided that covers an opened distal end of the channel 430. The cap may be coupled to the outer tube 422 via a strap. In aspects, a short, insulative sheath may be provided around the distal end of the outer tube 422 to which the cap may be attached.

The inner tube 424 has an opened proximal end portion 424*a* secured within the central channel 428 of the stopper 426 whereby the stopper 426 forms a fluid-tight seal between the proximal end portion 422*a* of the outer tube 422 and the proximal end portion 424*a* of the inner tube 424. The inner tube 424 defines a passageway 432 therethrough to allow for a flow of water to pass from the proximal end portion 424*a* of the inner tube 424 to a distal end portion 424*b* of the inner tube 424 to facilitate thawing of an ice straw formed in the elongated channel 424 from the freezable substance. The inner tube 424 further includes a distal end portion 424*b* that may protrude distally beyond the distal-most end of the outer tube 422 to prevent the freezable substance from overflowing into the inner tube 424.

The outer and inner tubes 422, 424 define an elongated channel 430 therebetween. The elongated channel 430 may assume a hollow, cylindrical shape and has an opened distal end portion 430*b* and a closed proximal end portion 430*a* such that the elongated channel 430 is configured to hold a freezable substance therein. It is contemplated that a top or distal end surface 427 of the stopper 426 forms a bottom of the elongated channel 430 and a distal-most end (not labeled) of the outer tube 422 forms a top of the elongated channel 430. In other aspects, instead of the stopper 426, a metal disc (not shown) may be welded between proximal and distal ends of the outer and inner tubes 422, 424 to close the bottom of the elongated channel 430. The opened proximal end 424*a* of the inner tube 424 is in fluid communication with the central opening 420 of the base 412 when the base 412 is coupled to the column assembly 414.

In use, flavored or unflavored drinking water, or another freezable, drinking liquid, may be poured into the opened distal end portion 430*b* of the elongated channel 430 until the liquid reaches the distal-most end of the outer tube 422 or a point proximally adjacent to the distal-most end. With the elongated channel 430 filled with the liquid, the ice mold 410 may be placed in a freezer in an upright or horizontal orientation until the liquid converts into ice. Since the elongated channel 430 has a ring-shaped cross-section, the ice formed within the elongated channel 430 assumes a straw-like shape, such as, for example, a cylinder with a central passageway therethrough. It is contemplated that the ice (i.e., ice straw) may have a length of from about 5 inches to about 9 inches, a wall thickness of about 0.12 inches, and a central channel with a diameter of about 0.24 inches.

To dislodge or remove the ice straw from the ice mold 410, the ice mold 410 may be turned upside down so that the cavity 416 defined in the stand 412 is facing upright and the opened distal end portion 430*b* of the elongated channel 430 is pointing downward. Thawing fluid (e.g., water having a temperature that is above 32 degrees Fahrenheit, such as room temperature water or lukewarm water) may be poured into the cavity 416 in the stand 412, whereby the thawing fluid concurrently passes through central opening 420 of the stand 412 and through the apertures 418 of the stand 412. The thawing fluid passes from the central opening 420 of the stand 412 into the inner tube 424 and from the apertures 418 onto an outer surface of the outer tube 422.

As the thawing fluid passes along the outer surface of the outer tube 422 and the inner surface of the inner tube 424, heat is transferred from the thawing fluid to the outer tube 422 and into the outer surface of the ice straw, and from the thawing fluid to the inner tube 424 and into the inner surface of the ice straw. As heat is transferred from the thawing fluid and into the outer and inner surfaces of the ice straw, the inner and outer surfaces of the ice straw sufficiently melt to allow for gravity to dislodge the ice straw from the ice mold 410. It is contemplated that thawing the inner and outer surfaces of the ice straw may be accomplished by removing the ice mold 400 from the freezer and allowing air (e.g., room temperature air) to flow through the inner tube 424 and along the outer surface of the outer tube 422 without using a thawing fluid.

Figure 15:
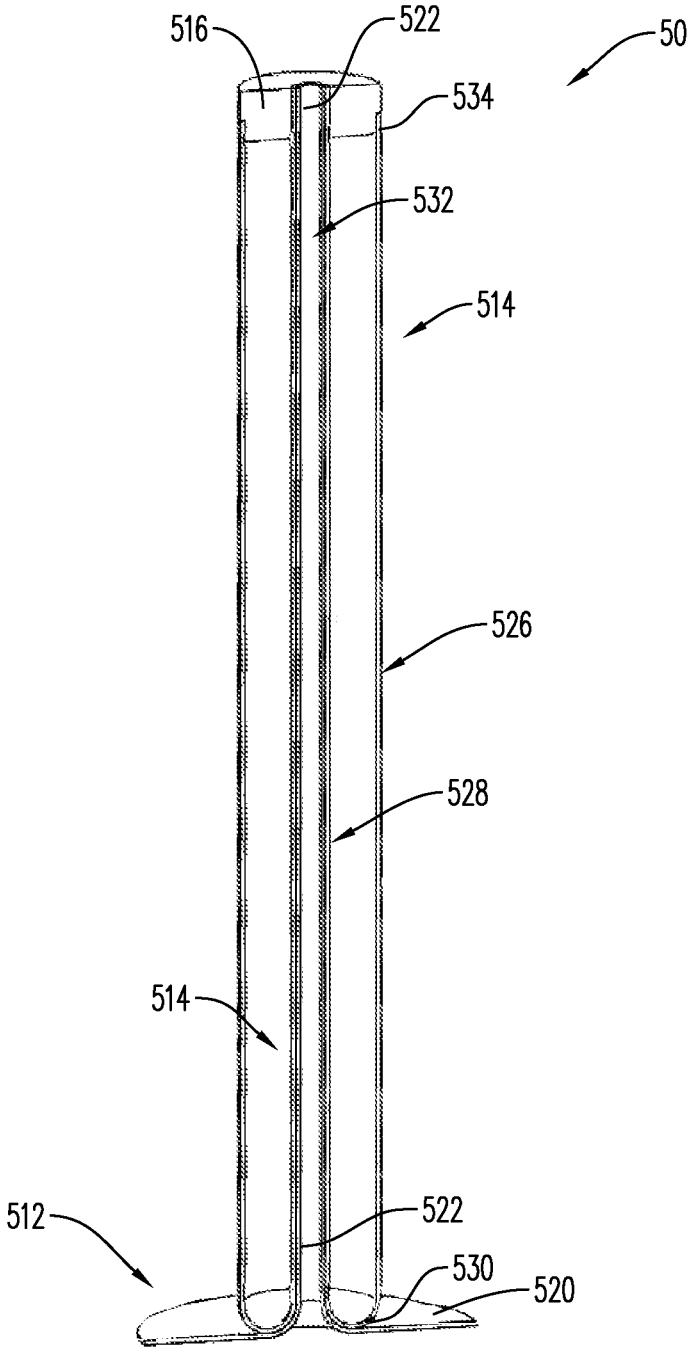
FIG. 15 is a longitudinal cross-sectional view of another embodiment of an ice mold for making ice molds.

With reference to FIG. 15, another embodiment of an ice tray or mold 500 for making drinking straws made from ice (i.e., ice straws or straw-shaped ice structures) is illustrated. The ice mold 500 generally includes a base or stand 512, a center body 514 extending vertically from the stand 512, and a cap 516 detachably coupled to the center body 514. The stand 512 includes a generally flat base 520 and a rigid insert or stem 522 extending perpendicularly from a center of the base 520. The stem 522 may be integrally formed with the base 520 and is fabricated from a rigid material, such as, for example, a hard plastic or metal. The stem 522 may define a passageway therethrough and is configured to extend through a central channel 532 of the center body 514 to maintain inner and outer tubes 526, 528 of the center body 514 in concentric relation to one another. In aspects, the stem 522 may be solid rather than having a passageway.

The center body 514 is fabricated from an elastic material, such as, for example, silicone, and has an outer tube 526 and an inner tube 528 positioned concentrically within the outer tube 526. The outer and inner tubes 526, 528 define a longitudinally-extending chamber 532 therebetween configured to be filled with a freezable substance. The outer and inner tubes 526, 528 are connected or integrally formed with one another at a proximal end 530 of the center body 514. As such, the proximal end 530 of the center body 514 is closed to permit the chamber 532 of the center body 514 to be filled with a freezable substance. The center body 514 has a distal end 534 that is opened to allow for removal of an ice straw that forms within the chamber 532. The cap 516 may be fabricated from an elastic material (e.g., rubber or silicone), and is configured to selectively fill the opened distal end 534 of the center body 514. Further, the cap 516 may secure the inner tube 528 in concentric relation with the outer tube 526 to ensure that the chamber 532 (and therefore the ice straw) has a uniform inner and outer diameter along its length.

In accordance with another aspect of the present disclosure, the center body 514 may be fabricated from a rigid material, such as, for example, stainless steel or aluminum. In this embodiment, the stem 522 is not required and the center body 514 may be supported on a flat base, such as, for example, the base 520.

In accordance with yet another aspect of the present disclosure, a system and method for forming straw-shaped ice structures is provided. The system may include one of the ice machine 100, the ice machine 200, the ice mold 10, the ice mold 50, or the ice mold 400, and pliable plastic wraps or envelopes (not shown) for individually enclosing each ice straw fabricated from one of the above-noted apparatus. The plastic wrap may be heat sealed around each ice straw, and a plurality of the enclosed ice straws may be sold in a package prefrozen. The ice straws may be flavored or unflavored. In other aspects, a pliable, plastic wrapper or envelope may be provided that defines a straw-shaped chamber in which a drinkable and freezable substance (e.g., flavored or unflavored water, coffee, iced tea, soda, etc.) is contained. The plastic wrapper may be sold with the liquid in an unfrozen form, and the end user may put the plastic wrapper into a freezer, whereby the liquid freezes and assumes a straw shape. Upon forming the straw shape, the plastic wrapper may be detached from the ice straw (e.g., along perforations).

With reference to FIGS. 16-19D, another embodiment of a device or ice mold 600 for making ice in the shape of drinking straws (i.e., ice straws or straw-shaped ice structures) is illustrated. The ice mold 600 is similar to the ice mold 500 described above. Therefore, only selected features of the ice mold 600 will be described in detail herein. The ice mold 600 generally includes an outer tube 602, an elongated inner member, such as, for example, an inner tube 604 configured to extend centrally through the outer tube 602, a top cap 606, and a bottom cap 608. The outer tube 602 may be fabricated from metal (e.g., stainless steel or anodized aluminum) and has an opened top end 602*a*, an opened bottom end 602*b*, and a passageway 602*c* extending therebetween. The inner tube 604 may be fabricated from metal (e.g., stainless steel or anodized aluminum) and has an opened top end 604*a*, an opened bottom end 604*b*, and a passageway 604*c* extending therebetween. In aspects, the elongated inner member 604 may be solid. The inner tube 604 has a smaller outer diameter than the outer tube 602 such that a radial gap extends between the outer tube 602 and the inner tube 604 when the inner tube 604 is concentrically positioned within the outer tube 604.

The top cap 606 is configured for receipt in the opened top end 602*a* of the outer tube 602, and the bottom cap 608 is configured for receipt in the opened bottom end 602*b* of the outer tube 602. It is contemplated that the top cap 606 or the bottom cap 608 may be interchangeable with each other such that either the top cap 606 or the bottom cap 608 may be coupled to either end of the outer tube 602. Each of the top cap 606 and the bottom cap 608 defines a respective central channel 610, 612 (FIGS. 18D and 19B, respectively) therethrough configured for receipt of the inner tube 604. The channel 610 of the top cap 606 is the only channel in the top cap 606, and the channel 612 of the bottom cap 608 is the only channel in the bottom cap 612. As such, when the top cap 606 and the bottom cap 608 are coupled to the respective top end 602*a* and bottom end 602*b* of the outer tube 602, and the inner tube 604 extends through the central channel 610, 612 of each of the top cap 606 and the bottom cap 608, the outer and inner tubes 602, 604 and the top and bottom caps 606, 608 collectively define a closed elongated channel 614 (FIG. 17) configured to hold a freezable substance (e.g., water) therein without allowing leakage of the freezable substance out of the elongated channel 614.

Figure 16:
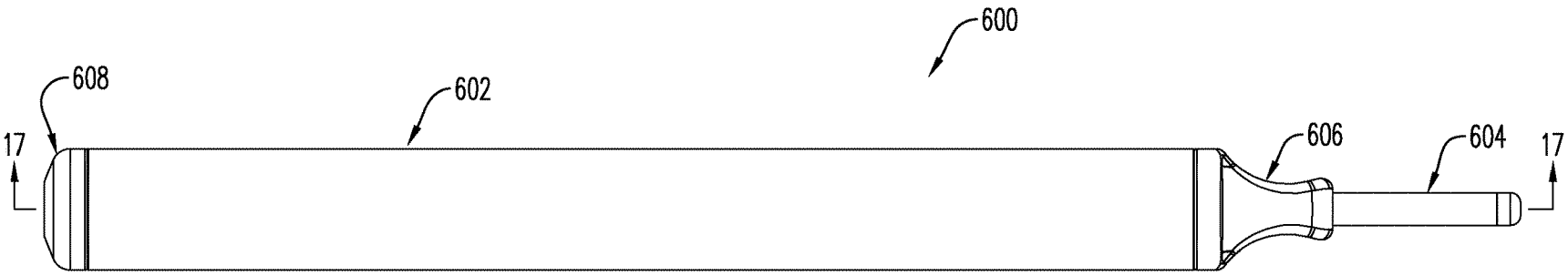
FIG. 16 is a side view illustrating another exemplary embodiment of a mold for making straw-shaped ice structures.

Each of the top cap 606 and the bottom cap 608 is fabricated from a resilient material, such as, for example, rubber, silicone, nitrile butadiene rubber, polyvinyl chloride, neoprene, or the like configured to form a fluid tight seal with each of the outer tube 602 and the inner tube 604. Since the top cap 606 forms a fluid-tight seal with the top end 602*a* of the outer tube 602, and the inner tube 604, and the bottom cap 608 forms a fluid-tight seal with the bottom end 602*b* of the outer tube 602, and the inner tube 604, the freezable substance is prevented from flowing out of the closed elongated channel 614 whether the mold 600 is oriented vertically (with a longitudinal axis of the mold 600 being parallel to the direction of gravity) or horizontally (with the longitudinal axis of the mold 600 being perpendicular to the direction of gravity, as shown in FIG. 16).

With reference to FIGS. 17 and 18A-18F, the top cap 606 may be a monolithic piece of resilient material (e.g., silicone, rubber, nitrile butadiene rubber, polyvinyl chloride, or neoprene) and includes an upper body portion 606*a*, a lower body portion 606*b* extending axially from the upper body portion 606*a*, and an outer annulus 606*c* extending radially outward from the lower body portion 606*b*. The upper body portion 606*a* is configured to protrude axially away from the top end 602*a* of the outer tube 602 and defines a pair of opposed depressions or finger grips 607 configured to assist a user in grasping the top cap 606.

The lower body portion 606*b* of the top cap 606 may have an outer diameter substantially equal to, but not greater than, an inner diameter of the outer tube 602 and the outer annulus 606*c* may have a slightly larger diameter than the inner diameter of the outer tube 602 to ensure that a fluid-tight seal is formed between the annulus 606*c* and an inner surface of the outer tube 602. By making the outer diameter of the lower body portion 606*b* substantially equal to, but in some aspects not greater than, the inner diameter of the outer tube 602, sliding of the top cap 606 into and out of the outer tube 602 by a user is permitted. The inner diameter of the central channel 610 (FIG. 18D) of the top cap 606 may be substantially equal to, but in some aspects without being less than, an outer diameter of the inner tube 604. The top cap 606 may have an inner annulus 616 protruding radially inward from the lower body portion 606*b* into the central channel 610 configured to form a fluid-tight seal with the outer surface of the inner tube 604. In aspects, any suitable dimensions for the inner and outer diameters of the top cap 606 may be provided.

It is contemplated that the upper body portion 606*a* of the top cap 606 may move axially away from the top end 602*a* of the outer tube 602 upon freezing of a freezable substance (e.g., water) in the enclosed elongate channel 614 to indicate that the freezable substance is frozen. For example, the length of the lower body portion 606*c* of the top cap 606 may be selected to allow for the lower body portion 606*b* to exit the top end 602*a* of the outer tube 602, while remaining supported on the top end 604*a* of the inner tube 604, during freezing of the freezable substance. To accomplish this, the lower body portion 606*b* may have a length that is less than or equal to about 9% the length of the enclosed elongated channel 614 such that the known 9% expansion by volume of water during freezing will be greater than the depth to which the lower body portion 606*c* extends into the top end 602*a* of the outer tube 602. In aspects, the top cap 606 may extend into the top end 602*a* of the outer tube 602 a depth from about 5% to about 15% of a length defined between an upper surface 620 (FIG. 17) of the bottom cap 608 and an upper-most edge 603 (FIG. 17) of the outer tube 602. In aspects, during freezing of the freezable substance, the top cap 606 may completely dislodge from the top end 602*a* of the outer tube 602 while remaining supported on the inner tube 604. It was unexpected that when the top cap 606 gradually begins to dislodge from the top end 602*a* of the outer tube 602 during the expansion of the freezable substance, the freezable substance freezes rapidly at the axial gap that forms between the top cap 606 and the top end 602*a* of the outer tube 602, therefore blocking further leakage of the freezable substance out of the elongated channel 614.

In aspects, the top end 602*a* of the outer tube 602 may define a vent hole (not explicitly shown) configured to be located in radial alignment with the lower body portion 606*b* of the top cap 606 when the top cap 606 is fully received in the top end 602*a* of the outer tube 602. The vent hole allows for air or an excess of freezable substance (e.g., water) in the elongated channel 614 to be vented out during insertion of the lower body portion 606*b* of the top cap 602 into the top end 602*a* of the outer tube 602 to ease insertion of the top cap 606. In addition, the vent hole may allow for air trapped in the elongated channel 614 to diffuse out of the elongated channel 614 as the freezable substance expands during freezing.

With reference to FIGS. 17 and 19A-19D, the bottom cap 608 of the mold 600 includes a lower body portion 608*a* and an upper body portion 608*b* extending axially from the lower body portion 608*a* and having a reduced outer diameter relative to the lower body portion 608*a*. The upper body portion 608*b* is configured to be fully received into the bottom end 602*b* of the outer tube 602 and the lower body portion 608*a* is configured to be positioned outside of the bottom end 602*b* of the outer tube 602. The upper body portion 608*a* may have an outer diameter equal to, substantially equal to, or slightly larger than an inner diameter of the bottom end 602*b* of the outer tube 602 to form a fluid-tight seal with the inner surface of the outer tube 602 while resisting, without preventing, sliding of the bottom cap 608 into and out of the bottom end 602*b* of the outer tube 602. The outer diameter of the upper body portion 608*b* of the bottom cap 608 may be slightly larger than the outer diameter of the lower body portion 606*b* of the top cap 606 to encourage the top cap 606 to slide more than the bottom cap 608 during expansion of the freezable substance. In aspects, the upper body portion 608*b* of the bottom cap 608 may extend deeper into the bottom end 602*b* of the outer tube 602 than the lower body portion 606*b* of the top cap 606 extends into the top end 602*a* of the outer tube 602.

The upper body portion 608*b* of the bottom cap 608 has a funnel-shaped upper surface 620 configured to guide the bottom end 604*b* of the inner tube 604 into the central channel 612 of the bottom cap 608 during assembly. The lower body portion 608*a* of the bottom cap 608 has a bottom end surface 618 that is tapered or ramped to assist in guiding water over the bottom cap 608 and onto an outer surface of the outer tube 602 (in a direction from the bottom end 602*b* toward the top end 602*a*) during a thawing and removal of the straw-shaped ice structure from the mold 600, as will be described in further detail below. The upper body portion 608*b* of the bottom cap 608 has an inner annulus 622 (FIG. 19B) extending radially inward into the central channel 612 configured to form a fluid-tight seal with the outer surface of the inner tube 604.

Figure 17:
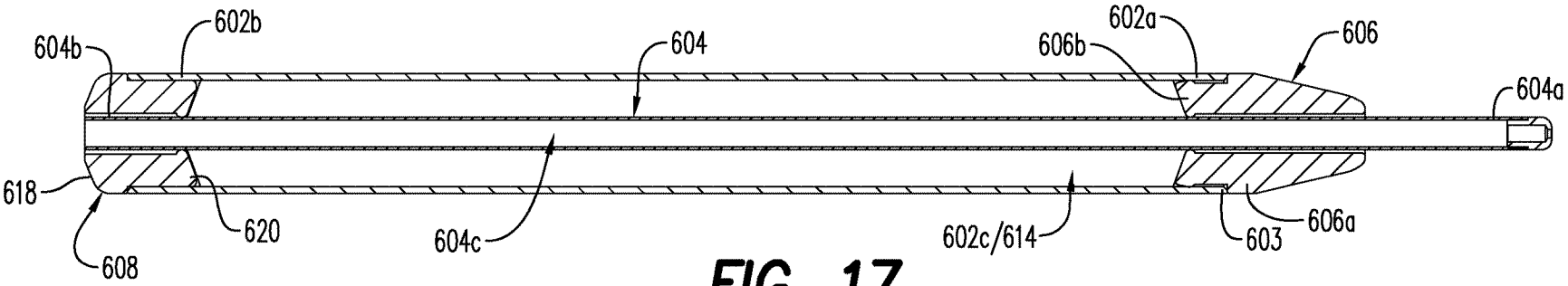
FIG. 17 is a longitudinal cross-section, taken along line 17-17 in FIG. 16, of the mold of FIG. 16.
Figure 18D:
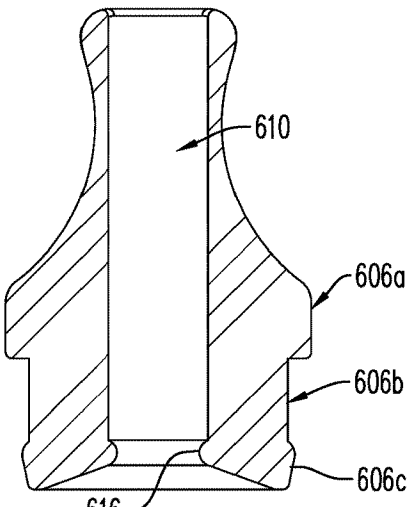
FIG. 18D is a longitudinal cross-section, taken alone line 18D-18D of FIG. 18C, of the top cap of FIG. 18C.
Figure 18C:
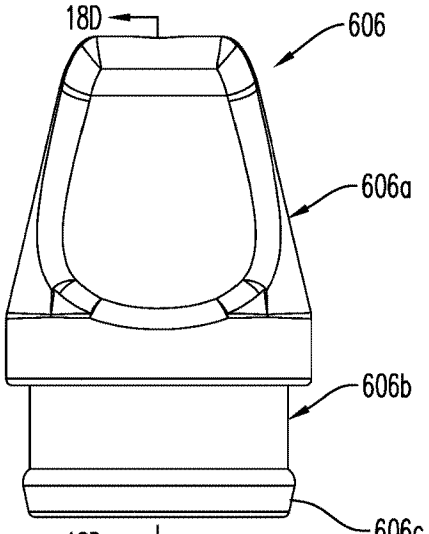
FIG. 18C is a right side view of the top cap.
Figure 18B:
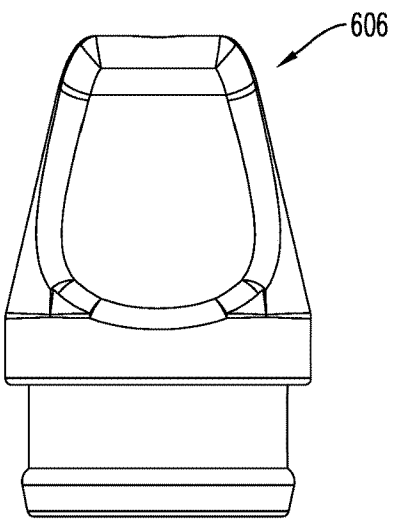
FIG. 18B is a left side view of the top cap.
Figure 18A:
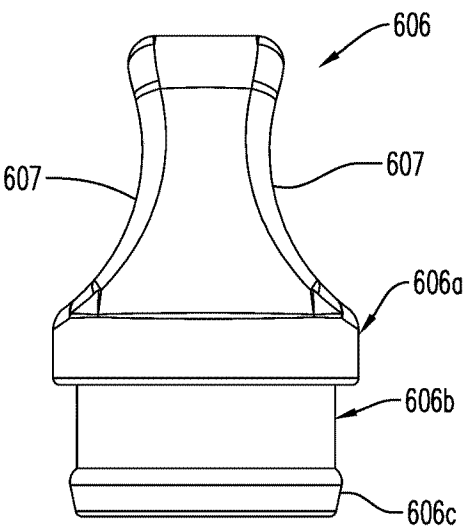
FIG. 18A is a front view of a top cap of the mold of FIG. 16.
Figure 18E:
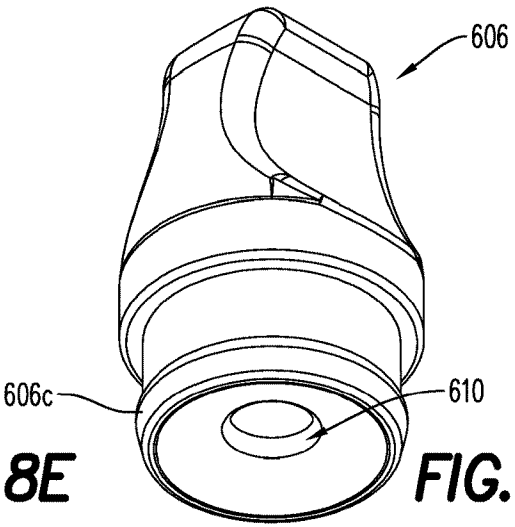
FIG. 18E is a top, perspective view illustrating the top cap of FIG. 18A.
Figure 18F:
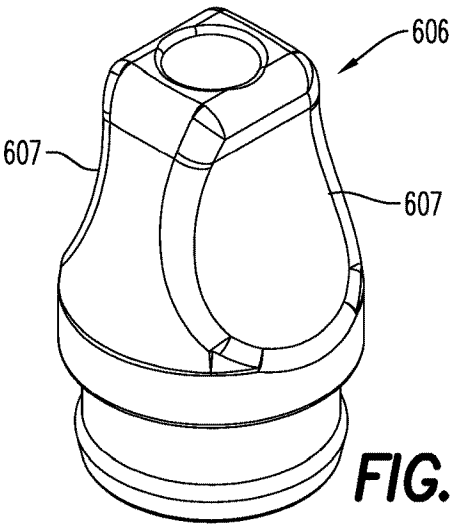
FIG. 18F is a bottom, perspective view of the top cap.
Figure 19B:
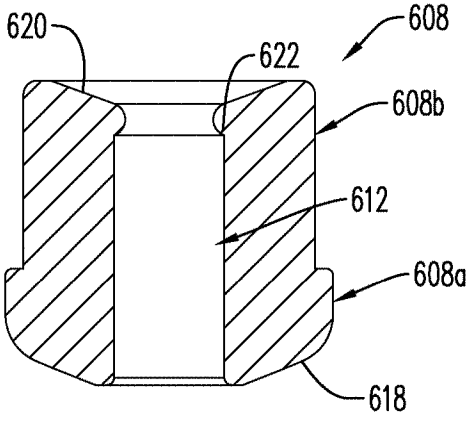
FIG. 19B is a longitudinal cross-section, taken alone line 19B-19B of FIG. 19A, of the bottom cap of the mold of FIG. 16.
Figure 19D:
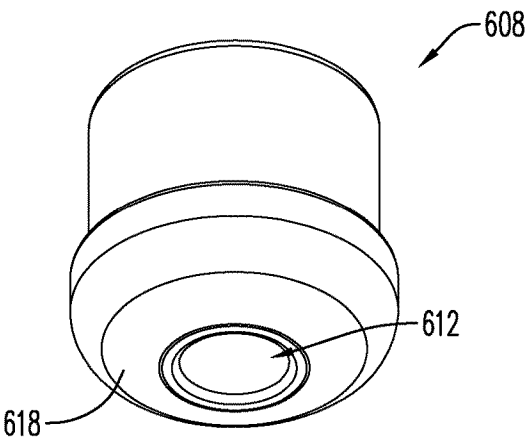
FIG. 19D is a bottom, perspective view illustrating the bottom cap.
Figure 19A:
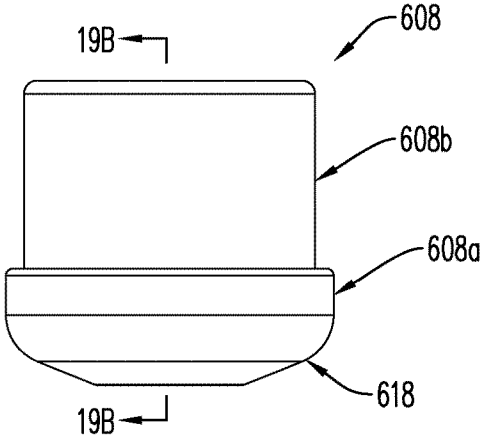
FIG. 19A is a side view illustrating a bottom cap of the mold of FIG. 16.
Figure 19C:
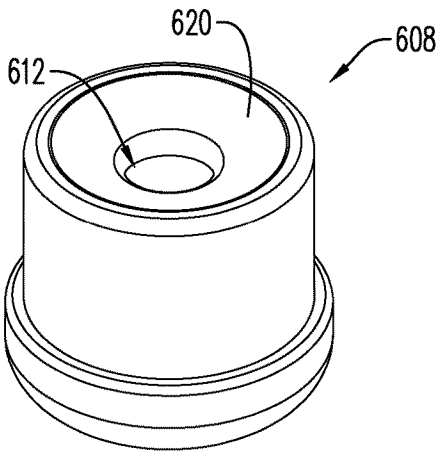
FIG. 19C is a top, perspective view illustrating the bottom cap.

In use, the upper body portion 608*b* of the bottom cap 608 is fully inserted into the bottom end 602*b* of the outer tube 602. The inner tube 604 is positioned within the outer tube 602 and the bottom end 602*b* of the inner tube 604 is received into the central channel 612 of the bottom cap 608. With the bottom cap 608 secured to the bottom end 602*b* of the outer tube 602 and the inner tube 604 secured to the bottom cap 608, flavored or unflavored drinking water, or another suitable freezable substance, may be poured into the opened top end 602*a* of the outer tube 602 and into the radial gap defined between the outer tube 602 and the inner tube 604 until the freezable substance reaches the upper-most edge 603 of the outer tube 602 or a point below the upper-most edge 603. For example, a fill line may be provided on the inner or outer surface of the outer tube 602 at a distance from the upper-most edge 603 of the outer tube 602 equal to about a length of the lower body portion 608*b* of the top cap 608. The top cap 606 may be positioned over the inner tube 602 and slid therealong until the lower body portion 608*b* of the top cap 608 is fully inserted in the top end 602*a* of the outer tube 602, thereby completing the assembly of the mold 600 (FIG. 17).

Figures 20A, 20B, 20C:
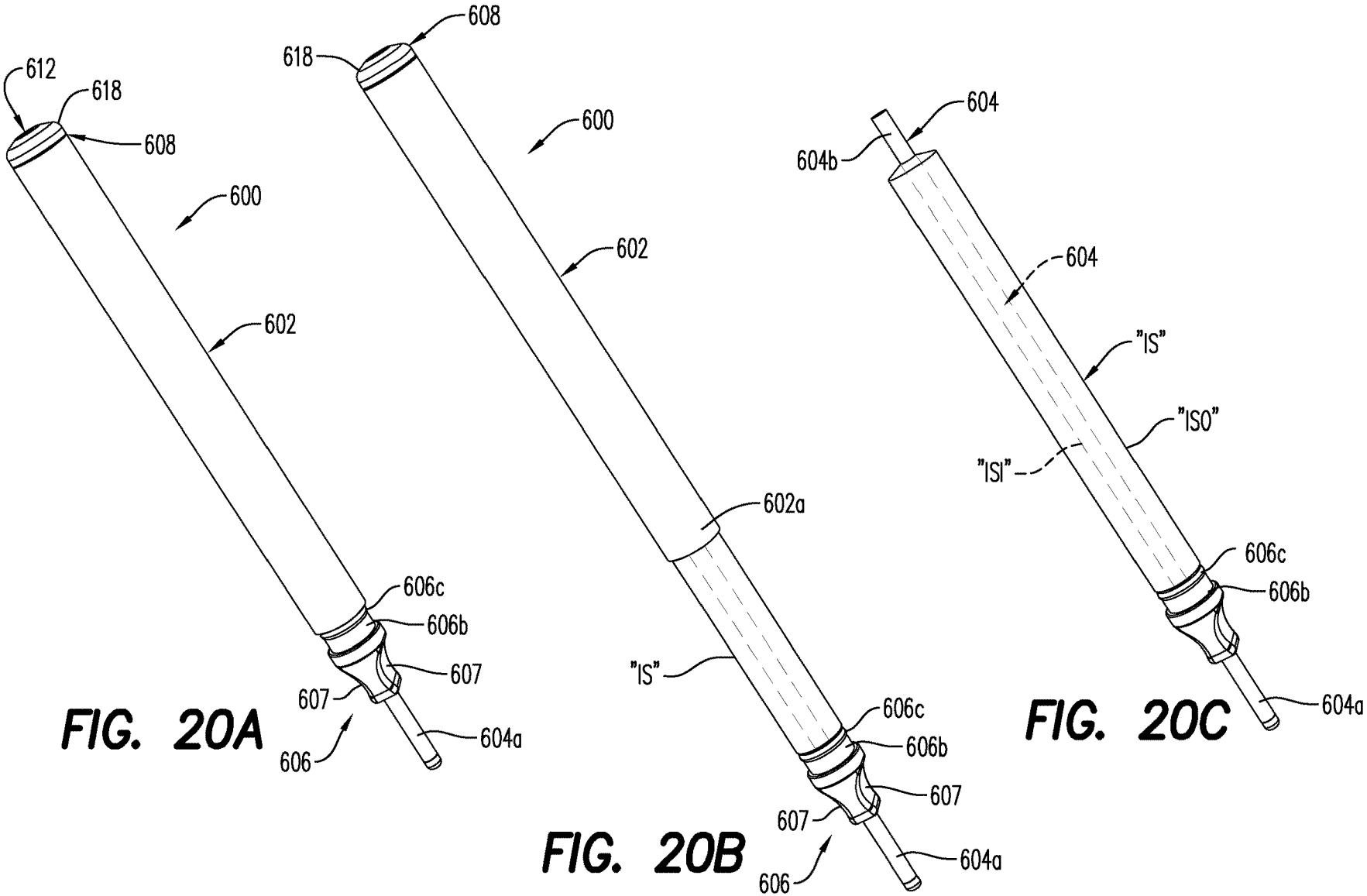
FIG. 20A is a perspective view illustrating a first stage of a freezing process of a freezable substance in the mold of FIG. 16.
FIG. 20B is a perspective view illustrating a removal of an outer tube of the mold after the freezable substance in the mold has turned into ice.
FIG. 20C is a perspective view illustrating a straw-shaped ice structure supported by a portion of the mold of FIG. 16 after the outer tube is fully removed.

Due to the freezable substance being fluidly sealed in the enclosed elongate channel 614 of the ice mold 600, the ice mold 600 may be placed in a freezer in either a vertical or horizontal orientation until the freezable substance converts from liquid to ice. As the freezable substance converts from liquid to ice, the freezable substance expands, whereby the expansion drives the top cap 608 axially relative to the top end 602*a* of the outer tube 602 in a direction away from the bottom end 602*b* of the outer tube 602 to expose the lower body portion 606*b* and/or the outer annulus 606*c* of the top cap 606, as shown in FIG. 20A. In aspects, the exposure of the entire lower body portion 608*b* including the annulus 606*c* from the outer tube 602 may function as a visual cue to the user that the freezing process is complete and the user may remove the mold 600 from the freezer to retrieve an ice straw "IS" (FIGS. 20B and 20C) that has formed within the elongated channel 614 of the mold 600. In some aspects, during freezing of the freezable substance, the bottom cap 608 may also slide, albeit to a lesser extent than the top cap 606, relative to the bottom end 602*b* of the outer tube 602 in a direction away from the top end 602*a* of the outer tube 602. Without allowing for the top and/or bottom caps 606, 608 to slide during freezing of the freezable substance, the ice formation could otherwise damage one or more components of the mold 600 and/or result in fracturing of the ice straw "IS".

To dislodge or remove the ice straw "IS" from the ice mold 600, the ice mold 600 may be turned upside down, in the position shown in FIG. 20A, so that the bottom cap 608 is located above the top cap 606. Thawing fluid (e.g., water having a temperature that is above 32 degrees Fahrenheit, such as room temperature water) may be directed onto the bottom end surface 618 of the bottom cap 608 and into the central cavity 612 of the bottom cap 608 and, in turn, through the entire length of the inner tube 604. Due to the taper of the bottom end surface 618 of the bottom cap 608, the bottom end surface 618 directs the thawing fluid over and along the entire length of the outer tube 602. As the thawing fluid passes along the outer surface of the outer tube 602 and the inner surface of the inner tube 604, heat is transferred from the thawing fluid to the outer tube 602 and into an outer surface "ISO" of the ice straw "IS", and from the thawing fluid to the inner tube 604 and into an inner surface "ISI" of the ice straw "IS". As heat is transferred from the thawing fluid and into the outer and inner surfaces "ISO," "ISI" of the ice straw "IS," the outer and inner surfaces "ISO," "ISI" of the ice straw "IS" sufficiently melt to allow for easy removal of the ice straw "IS" from the mold 600.

More specifically, with the mold 600 held in the upside down position, a user may grasp the finger grips 607 of the top cap 606 and the top end 604*a* of the inner tube 604 with one hand, and grasp any suitable portion of the outer tube 602 with the other hand. The user may then begin to separate the outer tube 602, with the bottom cap 608 still attached, from the remainder of the mold 600 (i.e., the inner tube 604 and the top cap 606) to begin to expose a top end portion of the ice straw "IS," as shown in FIG. 20B. A user may continue to pull or slide the outer tube 602 off the ice straw "IS" to fully expose the ice straw "IS," as shown in FIG. 20C. With the ice straw "IS" supported on a bottom surface of the top cap 606 and released from the outer tube 602, the user may then flip the inner tube 604 right side up, whereby the ice straw "IS" slides off the inner tube 604 and into a drinking vessel via gravity.

Figure 21:
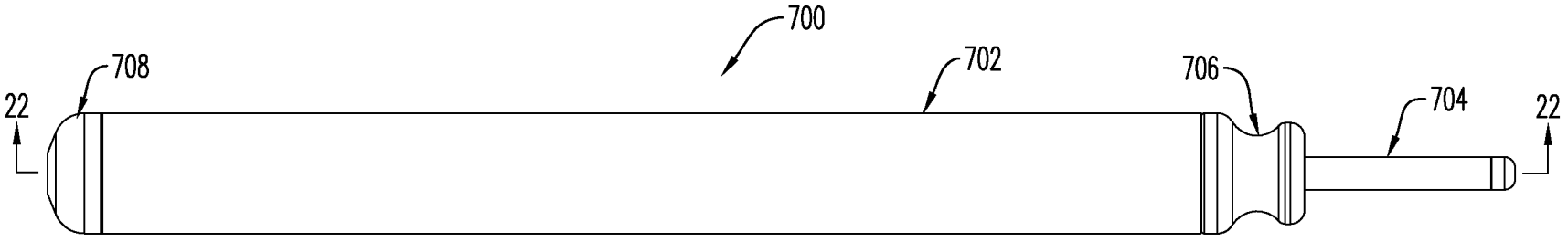
FIG. 21 is a side view illustrating another exemplary embodiment of a mold for making straw-shaped ice structures.
Figure 22:
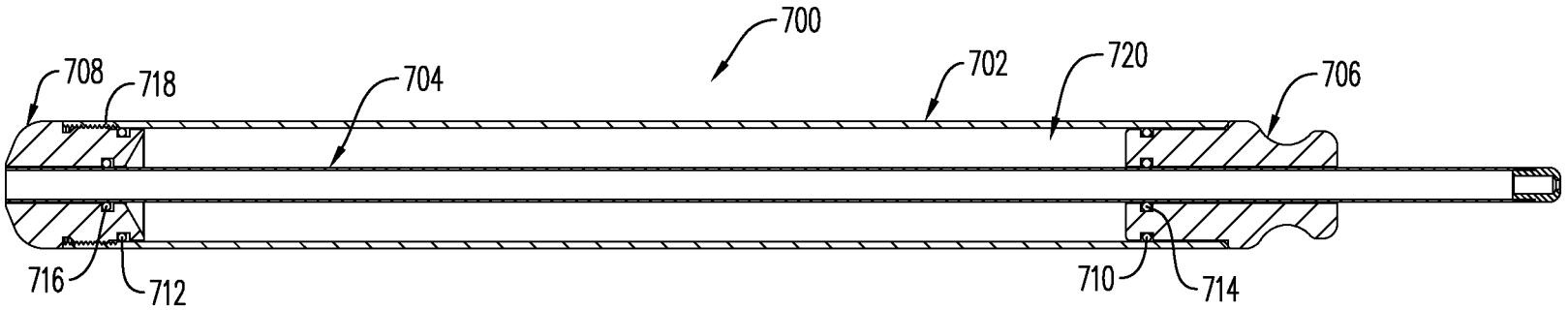
FIG. 22 is a longitudinal cross-section, taken along line 22-22 of FIG. 21, of the mold of FIG. 21.
Figure 23:
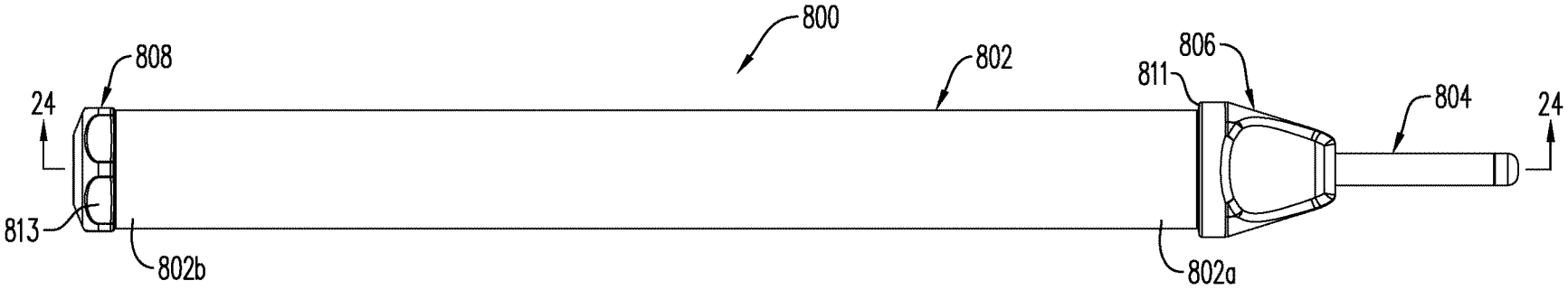
FIG. 23 is a side view illustrating another exemplary embodiment of a mold for making straw-shaped ice structures.
Figure 24:
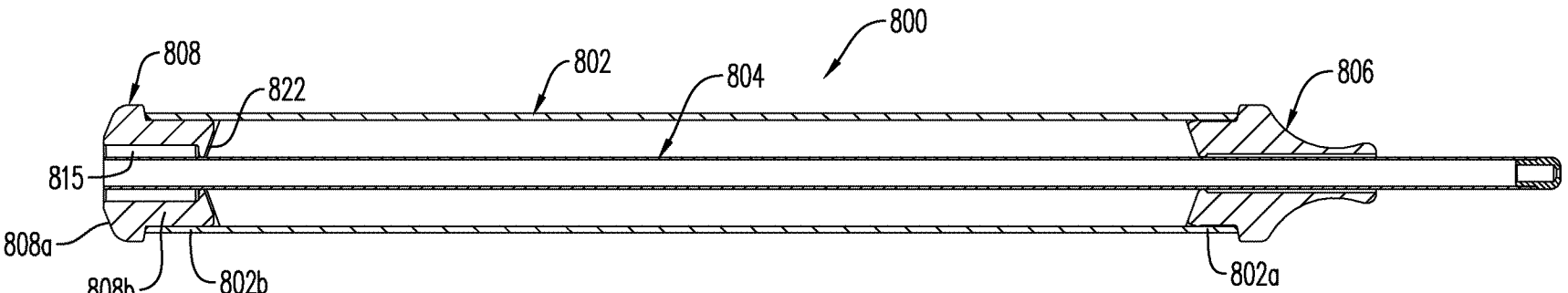
FIG. 24 is a longitudinal cross-section of the mold of FIG. 23.
Figure 25A:
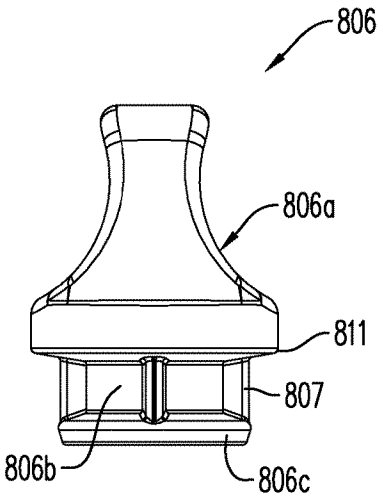
FIG. 25A is a front view of a top cap of the mold of FIG. 23.
Figure 25B:
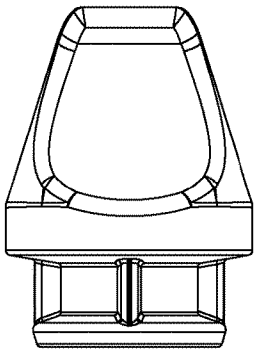
FIG. 25B is a left side view of the top cap.
Figure 25C:
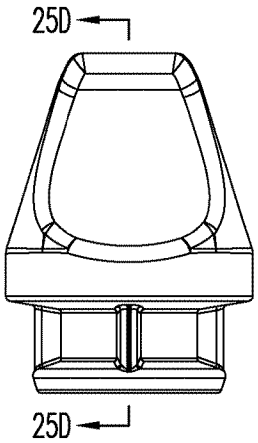
FIG. 25C is a right side view of the top cap.
Figure 25D:
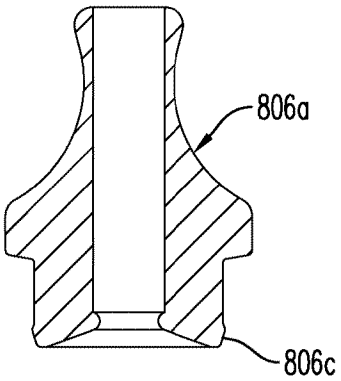
FIG. 25D is a longitudinal cross-section of the top cap of FIG. 25C.
Figure 25E:
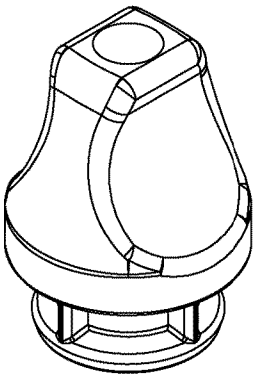
FIG. 25E is a top, perspective view illustrating the top cap of FIG. 25A.
Figure 25F:
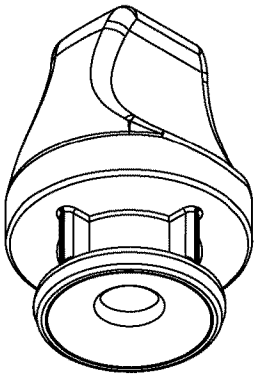
FIG. 25F is a bottom, perspective view of the top cap.

With reference to FIGS. 21 and 22, another embodiment of a device or ice mold 700 for making ice in the shape of a drinking straw (i.e., ice straws or straw-shaped ice structures) is illustrated. The ice mold 700 is similar to the ice mold 600 described above. Therefore, only selected features of the ice mold 700 will be described in detail herein. The ice mold 700 generally includes an outer tube 702, an elongated inner member, such as, for example, an inner tube 704 configured to extend centrally through the outer tube 702, a top cap 706, and a bottom cap 708. The outer tube 702 may be fabricated from metal (e.g., stainless steel or anodized aluminum) and the inner tube 704 may be fabricated from metal (e.g., stainless steel or anodized aluminum).

The ice mold 700 differs from the ice mold 600 in that the top cap 706 and the bottom cap 708 are fabricated from a metal, such as, for example, stainless steel, aluminum, or the like. Each of the top cap 706 and the bottom cap 708 defines an annular recess in an outer surface thereof that retains a respective seal 710, 712 (e.g., an O-ring). The seal 710, 712 of each of the top cap 706 and the bottom cap 708 forms a fluid-tight seal with an inner surface of the outer tube 702. Each of the top cap 706 and the bottom cap 708 also defines an annular recess in an inner surface thereof that retains a respective seal 714, 716 (e.g., an O-ring) configured to form a fluid tight seal with an outer surface of the inner tube 604. In aspects, the bottom cap 708 may be axially fixed to the outer tube 702 via a threaded engagement 718 such that only the top cap 708 is configured to slide axially relative to the outer tube 702 during expansion of the freezable substance in an enclosed elongated chamber 720 of the mold 700. In some aspects, each of the top cap 706 and the bottom cap 708 may be configured to slide relative to the outer tube 702 during expansion of the freezable substance. In other aspects, each of the top cap 706 and the bottom cap 708 may be axially fixed within the outer tube 702 such that the top cap 706 and the bottom cap 708 do not slide as the freezable substance expands within the enclosed elongated chamber 720.

With reference to FIGS. 23-26E, another embodiment of a device or ice mold 800 for making ice in the shape of a drinking straw (i.e., ice straws or straw-shaped ice structures) is illustrated. The ice mold 800 is similar to the ice mold 600 described above. Therefore, only selected features of the ice mold 800 will be described in detail herein. The ice mold 800 generally includes an outer tube 802, an elongated inner member, such as, for example, an inner tube 804 configured to extend centrally through the outer tube 802, a top cap 806, and a bottom cap 808. The outer tube 802 may be fabricated from metal (e.g., stainless steel or anodized aluminum) and the inner tube 804 may be fabricated from metal (e.g., stainless steel or anodized aluminum). The top cap 806 and the bottom cap 808 may each be fabricated from a resilient material, such as, for example, rubber, silicone, nitrile butadiene rubber, polyvinyl chloride, neoprene, or the like configured to form a fluid tight seal with each of the outer tube 802 and the inner tube 804.

With reference to FIGS. 23-25F, the top cap 806 includes an upper body portion 806*a*, a lower body portion 806*b* extending axially from the upper body portion 806*a*, and an outer annulus 806*c* extending radially outward from the lower body portion 806*b*. The upper body portion 806*a* is configured to protrude axially away from a top end 802*a* of the outer tube 802. The upper body portion 806*a* has a lip or ledge 811 configured to abut the top end 802*a* of the outer tube 802 and protrude radially outward therefrom to provide a non-metal surface for the user to grasp when removing the mold 800 from a freezer. The top cap 806 may further include a plurality of circumferentially spaced ribs 807 extending longitudinally between the upper body portion 806*a* and the outer annulus 806*c*. The ribs 807 and the lower body portion 806*b* are spaced radially inward from the inner surface of the outer tube 802 such that only the outer annulus 806*c* contacts the inner surface of the outer tube 802. The ribs 807 may provide structural integrity to the top cap 806.

With reference to FIGS. 23, 24, and 26A-26E, the bottom cap 808 of the mold 800 includes a lower body portion 808*a* and an upper body portion 808*b* extending axially from the lower body portion 808*a* and having a reduced outer diameter relative to the lower body portion 808*a*. The upper body portion 808*b* is configured to be fully received into the bottom end 802*b* of the outer tube 802 and the lower body portion 808*a* is configured to be positioned outside of the bottom end 802*b* of the outer tube 802. The lower portion body 808*a* protrudes radially outward from an outer surface of the outer tube 802 and may have a non-circular outer surface 813 configured to prevent the mold 800 from rolling on a flat surface when laid horizontally. In aspects, the outer surface 813 may have a hexagonal shape, and in other aspects may have other suitable shapes including pentagonal, square, triangular, or the like.

The upper body portion 808*a* of the bottom cap 808 may have an outer diameter equal to, substantially equal to, or slightly larger than an inner diameter of the bottom end 802*b* of the outer tube 802 to form a fluid-tight seal with the inner surface of the outer tube 802 while resisting, without preventing, sliding of the bottom cap 808 into and out of the bottom end 802*b* of the outer tube 802. Since more surface area of the upper body portion 808*b* of the bottom cap 808 is engaged with the inner surface of the outer tube 802 compared to the surface area of the lower body portion 806*b* of the top cap 806 that is engaged with the inner surface of the outer tube 802, the top cap 806 is encourage to slide relative to the outer tube 802 more than the bottom cap 808 during expansion of the freezable substance.

Figure 26C:
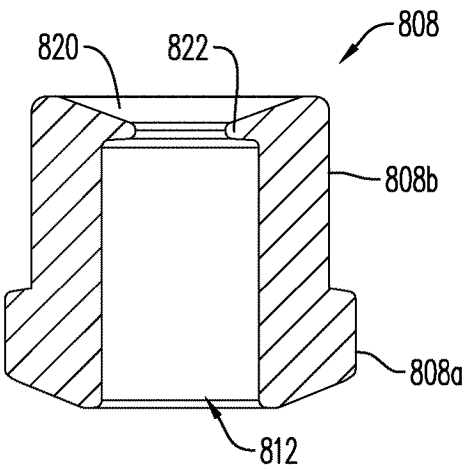
FIG. 26C is a longitudinal cross-section of the bottom cap of the mold of FIG. 23.
Figure 26B:
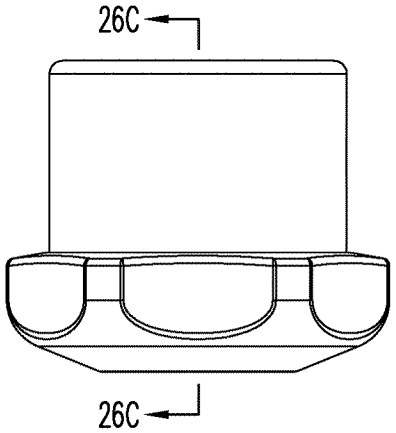
FIG. 26B is a right side view illustrating the bottom cap of the mold of FIG. 23.
Figure 26A:
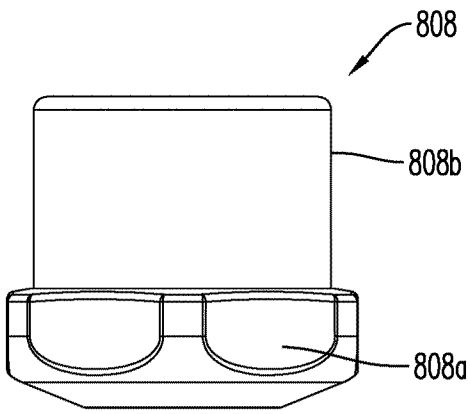
FIG. 26A is a left side view illustrating a bottom cap of the mold of FIG. 23.
Figure 26E:
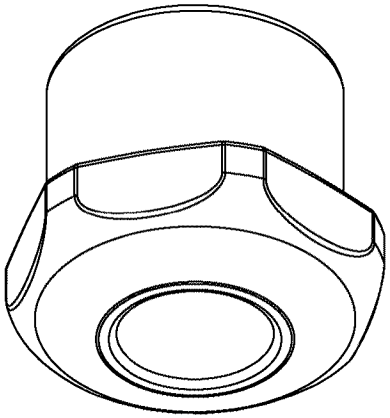
FIG. 26E is a bottom, perspective view illustrating the bottom cap of the mold of FIG. 23.
Figure 26D:
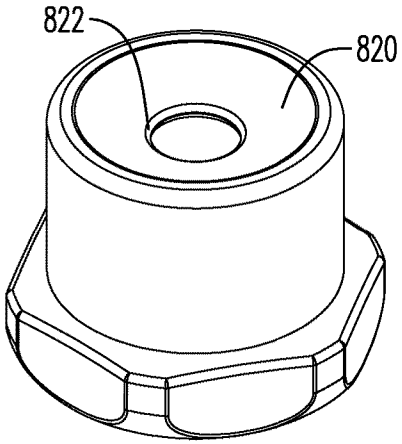
FIG. 26D is a top, perspective view illustrating the bottom cap of the mold of FIG. 23.

The bottom cap 808 defines a central channel 812 configured to receive the inner tube 804. The central channel 812 may have a diameter that is greater than an outer diameter of the inner tube 804 such that a radial gap 815 (FIG. 24) is defined between the inner tube 804 and the bottom cap 808. The upper body portion 808*b* of the bottom cap 808 has a funnel-shaped upper surface 820 that terminates in a radial projection, such as, for example, a diaphragm 822 (FIG. 26C). The diaphragm 822 extends radially inward into the central channel 812 of the bottom cap 808 and forms a fluid-tight seal with the outer surface of the inner tube 804. The diaphragm 822 of the bottom cap 808 is configured to ease insertion of the top cap 806 into the top end 802*a* of the outer tube 802 by allowing the liquid, freezable substance to vent passed the diaphragm 822 and out of the mold 800 as the top cap 806 is pushed into the top end 802*a* of the outer tube 802.

It will be understood that various modifications may be made to the embodiments disclosed herein. Therefore, the above description should not be construed as limiting, but merely as exemplification of the various embodiments. Those skilled in the art will envision other modifications within the scope and spirit of the claims appended hereto.

What is claimed is:

1. A mold for forming a straw-shaped ice structure, the mold comprising:

an outer tube having an opened top end, and an opened bottom end;

an inner tube configured to extend centrally through the outer tube, the inner tube having an opened top end, and an opened bottom end;

a top cap configured to be coupled to the opened top end of the outer tube, the top cap defining a channel therethrough configured for receipt of the inner tube; and a bottom cap configured to be coupled to the opened bottom end of the outer tube, the bottom cap defining a channel therethrough configured for receipt of the inner tube, wherein the outer and inner tubes and the top and bottom caps are configured to collectively define a closed elongated channel therebetween configured to hold a freezable substance therein, wherein the top and bottom caps are configured to prevent the freezable substance from exiting the closed elongated channel via the top and bottom ends of the outer tube when the mold is oriented perpendicular to the direction of gravity, wherein the bottom cap includes:

a body portion; and a diaphragm extending radially inward from the body portion and into engagement with the inner tube, the diaphragm forming a fluid-tight seal with the inner tube and configured to permit venting of at least one of air or the freezable substance from the closed elongated channel during insertion of the bottom cap into the bottom end of the outer tube.

2. The mold according to claim 1, wherein at least one of the top cap or the bottom cap is configured to move axially relative to the outer tube during freezing of the freezable substance.

3. The mold according to claim 2, wherein the top cap is configured to slide relative to the top end of the outer tube in a direction away from the bottom end of the outer tube during freezing of the freezable substance.

4. The mold according to claim 2, wherein the bottom cap is configured to slide relative to the bottom end of the outer tube in a direction away from the top end of the outer tube during freezing of the freezable substance.

5. The mold according to claim 1, wherein a portion of the top cap is received within the top end of the outer tube, and a portion of the bottom cap is received in the bottom end of the outer tube.

6. The mold according to claim 5, wherein the portion of each of the top cap and the bottom cap is fabricated from a non-metal material.

7. The mold according to claim 1, wherein the top cap forms a fluid-tight seal with the top end of the outer tube, and the inner tube, and the bottom cap forms a fluid-tight seal with the bottom end of the outer tube, and the inner tube, such that a flow of the freezable substance out of the closed elongated channel is resisted when the mold is oriented perpendicular to the direction of gravity.

8. The mold according to claim 7, wherein each of the top cap and the bottom cap is fabricated from a non-metal material.

9. The mold according to claim 1, wherein the channel of the top cap is the only channel in the top cap, and the channel of the bottom cap is the only channel in the bottom cap.

10. The mold according to claim 1, wherein each of the outer tube and the inner tube is fabricated from a metal, and each of the bottom cap and the top cap is fabricated from a non-metal material.

11. The mold according to claim 1, wherein the top cap has an upper body portion protruding from the top end of the outer tube, and a lower body portion received within the top end of the outer tube.

12. The mold according to claim 1, wherein the bottom cap has an upper-most surface and the outer tube has an upper-most end, and the top cap extends into the top end of the outer tube a depth that is substantially equal to 5%-15% of a length defined between the upper-most surface of the bottom cap and the upper-most end of the outer tube.

13. The mold according to claim 1, wherein the channel of the bottom cap has a funnel shape configured to guide the bottom end of the inner tube into the channel of the bottom cap.

14. The mold according to claim 1, wherein the bottom cap has a tapered or ramped bottom end surface configured to guide a flow of water over an outer surface of the outer tube.

15. A mold for forming ice straws, the mold comprising:

a hollow, outer tube having a top end and a bottom end;

a top cap coupled to the top end of the outer tube and defining a central channel;

a bottom cap coupled to the bottom end of the outer tube and defining a central channel; and an elongated inner member positioned concentrically within the outer tube and including:

a top end extending through or protruding from the central channel of the top cap; and a bottom end extending through or protruding from the central channel of the bottom cap, wherein the top cap closes the top end of the outer tube, and the bottom cap closes the bottom end of the outer tube to resist a freezable substance from leaking out of the outer tube via either the top end of the outer tube or the bottom end of the outer tube, wherein at least one of the top cap or the bottom cap includes:

a body portion configured for coupling to the top end or the bottom end of the outer tube; and a diaphragm extending radially inward from the body portion and into the central channel of the top cap or the bottom cap, the diaphragm forming a fluid-tight seal with the elongated inner member and configured to permit venting of at least one of air or the freezable substance past the diaphragm and out of the mold as the top cap is pushed into the top end of the outer tube or the bottom cap is pushed into the bottom end of the outer tube.

16. The mold according to claim 15, wherein the outer tube and the elongated inner member and the top and bottom caps define an enclosed elongated channel therebetween, the enclosed elongated channel being configured to hold the freezable substance therein.

17. The mold according to claim 16, wherein the top cap is configured to move axially away from the top end of the outer tube as the freezable substance expands within the enclosed elongated channel.

18. The mold according to claim 15, wherein the outer tube is fabricated from metal and the elongated inner member is a metal tube, and wherein each of the top cap and the bottom cap is fabricated from a non-metal material.

19. A mold for forming a straw-shaped ice structure, the mold comprising:

a metal outer tube having an opened top end, and an opened bottom end;

a metal inner tube configured to extend centrally through the outer tube, the inner tube having an opened top end, and an opened bottom end;

a non-metal top cap configured to be coupled to the opened top end of the outer tube, the top cap defining a channel therethrough configured for receipt of the inner tube; and a bottom cap configured to be coupled to the opened bottom end of the outer tube, the bottom cap defining a channel therethrough configured for receipt of the inner tube, wherein the outer and inner tubes and the top and bottom caps are configured to collectively define a completely closed elongated channel therebetween configured to hold a freezable substance therein, wherein the top cap includes:

a body portion; and a diaphragm extending radially inward from the body portion and into engagement with the inner tube, the diaphragm forming a fluid-tight seal with the inner tube and configured to permit venting of at least one of air or the freezable substance from the closed elongated channel during insertion of the top cap into the opened top end of the outer tube.

* * * * *